US010309138B2

(12) United States Patent
Header

(10) Patent No.: US 10,309,138 B2
(45) **Date of Patent: *Jun. 4, 2019**

(54) ADJUSTABLE PATH GUIDE FOR MOVABLE PARTITION ASSEMBLIES

(71) Applicant: Gregory A Header, Richland, PA (US)

(72) Inventor: Gregory A Header, Richland, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/102,095

(22) Filed: Aug. 13, 2018

(65) Prior Publication Data

US 2018/0363345 A1 Dec. 20, 2018

Related U.S. Application Data

(63) Continuation of application No. 15/626,053, filed on Jun. 16, 2017, now Pat. No. 10,077,588.

(51) Int. Cl.
*E05D 15/06* (2006.01)
*E04B 2/82* (2006.01)

(52) U.S. Cl.
CPC ..... *E05D 15/0608* (2013.01); *E04B 2/827* (2013.01); *E05D 15/063* (2013.01); *E05D 15/0652* (2013.01); *E05D 15/0613* (2013.01); *E05Y 2201/614* (2013.01); *E05Y 2201/684* (2013.01); *E05Y 2900/142* (2013.01)

(58) Field of Classification Search
CPC ..... E05D 15/0608; E05D 15/063; E05D 15/0652; E05D 15/0613; E04B 2/827; E05Y 2900/142; E05Y 2201/614; E05Y 2201/684
USPC ..... 49/127; 52/64, 238.1, 243.1, 242; 16/95 R, 94 R, 96 R, 87 R; 104/105, 104/130.09
See application file for complete search history.

(56) References Cited

U.S. PATENT DOCUMENTS

| | | | |
|---|---|---|---|
| 570,711 | A | 11/1896 | Newhall |
| 840,732 | A | 1/1907 | Wyeth |
| 963,752 | A | 7/1910 | Duner |
| 1,246,314 | A | 11/1917 | Palmer |
| 1,357,299 | A | 11/1920 | Phillips |
| 1,570,958 | A | 1/1926 | Frantz |

(Continued)

FOREIGN PATENT DOCUMENTS

| | | | |
|---|---|---|---|
| AU | 4121868 | A1 | 1/1970 |
| CA | 2106766 | A1 | 9/1992 |

(Continued)

OTHER PUBLICATIONS

Installation Manual Nana Wall HSW75 Single Track Sliding Frameless System, Dec. 2015, Nana Wall Systems, Inc., Corte Madera, California, US.

(Continued)

*Primary Examiner* — Brent W Herring
(74) *Attorney, Agent, or Firm* — Stone Creek Services LLC; Alan M Flum

(57) ABSTRACT

A movable partition system that can include branched overhead rails where movable panels, such as glass doors, wall panels, are guided along the branched overhead rails by path guides positioned with the overhead rails. The guide paths are shaped and aligned within the overhead rails to provide a smooth transition at the junction between overhead rails. The combination is suitable for use with both right-angle and oblique angle branched overhead rails.

18 Claims, 22 Drawing Sheets

(56) References Cited

U.S. PATENT DOCUMENTS

| | | | | |
|---|---|---|---|---|
| 2,657,436 | A | 11/1953 | Fairhurst | |
| 2,841,219 | A | 7/1958 | Helwig | |
| 2,944,282 | A | 7/1960 | Greco | |
| 3,015,359 | A | 1/1962 | Ogburn | |
| 3,052,000 | A | 9/1962 | Ferrett | |
| 3,071,825 | A | 1/1963 | Ferris | |
| 3,241,197 | A | 3/1966 | Gogerty | |
| 3,279,123 | A | 10/1966 | Genison | |
| 3,334,375 | A * | 8/1967 | Hubbard | E05D 15/0608 16/100 |
| 3,343,205 | A | 9/1967 | Gogerty | |
| 3,494,407 | A | 2/1970 | Hollands et al. | |
| 3,610,313 | A | 10/1971 | Friedrich | |
| 3,708,916 | A | 1/1973 | Karp, Jr. | |
| 3,843,995 | A | 10/1974 | Merrill | |
| 3,879,799 | A | 4/1975 | Williams | |
| 4,141,106 | A | 2/1979 | Dixon | |
| 4,214,535 | A | 7/1980 | Gerhard | |
| 4,302,865 | A | 12/1981 | Dixon | |
| 4,555,828 | A | 12/1985 | Matimura | |
| 4,569,164 | A | 2/1986 | Dickson | |
| 4,752,987 | A | 6/1988 | Dreyer et al. | |
| 4,852,628 | A | 8/1989 | Klein | |
| 5,016,318 | A | 5/1991 | Harris | |
| 5,181,296 | A | 1/1993 | Williams | |
| 5,230,123 | A | 7/1993 | Williams | |
| 5,329,857 | A | 7/1994 | Owens | |
| 5,357,651 | A | 10/1994 | Jones et al. | |
| 5,406,676 | A | 4/1995 | Williams | |
| 5,448,855 | A | 9/1995 | Sjoholm | |
| 6,581,242 | B2 | 6/2003 | Owens | |
| 7,185,589 | B2 | 3/2007 | Owens | |
| 7,255,045 | B2 | 8/2007 | Owens | |
| 8,186,123 | B2 | 5/2012 | Klaffke et al. | |
| 8,256,062 | B2 | 9/2012 | Banks | |
| 8,590,233 | B2 | 11/2013 | Sprague | |
| 8,627,621 | B2 | 1/2014 | Liebscher et al. | |
| 8,819,993 | B1 | 9/2014 | Chen | |
| 9,228,387 | B2 | 1/2016 | Header | |
| 9,470,028 | B2 | 10/2016 | Header et al. | |
| 10,077,588 | B1 * | 9/2018 | Header | E05D 15/0608 |
| 2005/0011398 | A1 | 1/2005 | Owens | |
| 2006/0096494 | A1 | 5/2006 | Owens | |
| 2008/0109989 | A1 | 5/2008 | Sprague | |
| 2008/0190043 | A1 | 8/2008 | Beckmann | |
| 2009/0217839 | A1 | 9/2009 | Banks | |
| 2010/0038041 | A1 | 2/2010 | Lao | |
| 2010/0050530 | A1 | 3/2010 | Blasi | |
| 2010/0205865 | A1 | 8/2010 | Iwauchi et al. | |
| 2010/0243179 | A1 | 9/2010 | Burggraaf et al. | |
| 2013/0312333 | A1 * | 11/2013 | Liao | E05D 15/0608 49/425 |
| 2016/0083985 | A1 | 3/2016 | Header | |
| 2016/0083986 | A1 | 3/2016 | Header | |
| 2018/0209145 | A1 * | 7/2018 | Dickson | E04B 2/827 |

FOREIGN PATENT DOCUMENTS

| | | | |
|---|---|---|---|
| DE | 9001083 | U1 | 8/1991 |
| DE | 102004027753 | A1 | 1/2006 |
| DE | 202014102828 | A1 | 8/2014 |
| EP | 1693541 | A2 | 8/2006 |
| EP | 2360335 | B1 | 9/2012 |
| EP | 2636835 | B1 | 7/2015 |
| EP | 2982820 | A2 | 2/2016 |
| GB | 367542 | A | 2/1932 |
| GB | 749539 | A | 5/1956 |
| GB | 1339747 | A | 12/1973 |
| GB | 1415158 | A | 1/1975 |
| JP | 2575328 | B2 | 12/1991 |
| JP | 5163865 | A | 6/1993 |
| JP | 2895446 | B2 | 1/1998 |
| WO | 0011298 | A1 | 3/2000 |
| WO | 2006089758 | A1 | 8/2006 |

OTHER PUBLICATIONS

Henderson 45R/550 AC 45 Degrees Right Without Rail Material, downloaded from the Internet from http://www.qlussen.nl/item/Q11115638/Henderson-45R-550-wissel-45-graden-rechts-zonder-railmateriaal-C40-00010 on Dec. 22, 2016 (both original Dutch and Google machine translation into English).

Flexirol Multidirectional FRP02 Glass Profile, downloaded from https://www.pchenderson.com/wp-content/uploads/2016/08/Flexirol-Multidirectional-FRP02-Glass-LVLA.pdf on Dec. 22, 2016.

Commercial Sliding Door Hardware, Aug. 2016, pp. 37-48, PC Henderson Limited, Bowburn, Great Britain.

Stainless Steel Custom Bearings Moveable Glass Wall Partitions, Publication No. P-7282-KM, Apr. 2012, Kilian Manufacturing, Syracuse, New York, US.

Selected frames from Nanawall FoldFat® video showing construction of folding door and tracks, Downloaded from the Internet at https://www.nanawall.com/ on Feb. 16, 2017.

Screenshots from Nanawall FoldFat® video, downloaded from the Internet at https://www.nanawall.com/fold-flat on Feb. 16, 2017.

NanaWall FoldFlat web page, downloaded from the Internet at https://www.nanawall.com/products/foldflat on Feb. 16, 2017.

Opening Glass Walls: Residential and Commercial | Folding, Sliding, Frameless, Sep. 2014, p. 35, NanaWall Systems, Inc., Cotre Madera, California, United States.

Aluminum Folding Systems, Sep. 2016, NanaWall Systems, Inc., Cotre Madera, California, United States.

Nulook Architects Manual, Version 1, 2011, May 2011, Chapter 2: Sovereign Series, pp. 62-75, Altus NZ Ltd., Auckland, New Zealand.

Non-Final Office Action for U.S. Appl. No. 15/626,053, dated Jan. 22, 2018, United States Patent and Trademark Office, Alexandria, Virginia, United States.

Final Office Action for U.S. Appl. No. 15/626,053, dated Jul. 5, 2018, United States Patent and Trademark Office, Alexandria, Virginia, United States.

Notice of Allowance for or U.S. Appl. No. 15/626,053, dated Jul. 25, 2018, United States Patent and Trademark Office, Alexandria, Virginia, United States.

* cited by examiner

ADJUSTABLE PATH GUIDE FOR MOVABLE PARTITION ASSEMBLIES

CROSS-REFERENCE TO RELATED APPLICATIONS

This application is a continuation of U.S. patent application Ser. No. 15/626,053, filed Jun. 16, 2017. The entire contents of U.S. patent application Ser. No. 15/626,053 are incorporated by reference.

BACKGROUND

The present disclosure relates to fenestration systems. Specifically, to movable partition assemblies using multi-path overhead guide rails.

Movable partition assemblies can be found in a wide-range of applications. For example, movable room partitions, sliding closet doors, sliding glass door panels, glazed terrace doors, and store front openings. Movable partition assemblies can include one or more overhead rails that guide the movement of movable panels. The movable panels can be suspended by wheeled trolleys, vertical or horizontal rollers, helical bearings, or other operable carriers.

With some movable partition assemblies, the movable panels slide along an overhead linear track, or overhead guide rails, that extend the width of the fenestration opening. For example, for a sliding glass door, glass door panels can be suspended by operable carriers on an overhead guide rail that extends the width of the door opening. The glass door panels can be arranged along parallel paths on the overhead guide rail so that one glass door panel slides behind the other. With this arrangement, the door opening can remain partially impeded because the glass door panels slide behind one another and remain within the door opening.

In some commercial and residential applications, it may be desirable to move the movable panels completely outside the door opening. For example, a commercial entrance to a department store within a shopping mall, or a wide terrace door opening in a residential home or apartment. One way that this has been done is by splitting or branching the overhead rails into multiple paths and then diverting the movable panels or a portion of the movable panels along one of the branched overhead rails. This allows the movable panels to be moved and arranged in more sophisticated ways than a single linear overhead rail. For example, in some arrangements, the movable panels can be stacked one behind another outside the door opening. Some movable partition assemblies with two or more movable panels are designed so one side of the movable panel can be diverted to one overhead rail while the other side of the movable panel is diverted to a different overhead rail. For example, a glass door panel system with multi-path overhead rails can be configured to divert each glass door panels from a single overhead rail to a pair of parallel overhead rails with each side of each glass door panel moving along different rails.

Various schemes have been devised to selectively divert movable panels from one overhead guide rail to another. Some of these include using path diverters or path guides that divert some operable carriers but not others.

SUMMARY

The inventor observed that sliding movable panels, especially heavy glass door panels, can be difficult to move around the juncture between one overhead guide rail and another. This can cause challenges at any transition angle, and can be particularly difficult at steeper angles, for example right-angle junctures. The inventor discovered that he could create a much smoother transition at junctures between one overhead rail and another by creating path guides, or diverters, that include leading and trailing running surfaces (i.e. leading and trailing roller guide engaging surfaces) that are parallel to the length-wise axis of their respective overhead rails and that engage self-centering guide rollers along paths tangent to the edge of the guide rollers. This minimizes the resistance to movement typically encountered in other overhead rail systems. In addition, to further minimize resistance, the leading edge of the leading running surface can be radiused or tapered to gently guide the self-centering roller guide back to center.

The path guide could include a main body positioned at least in part within the leading overhead rail (i.e. the first rail). The leading running surface (i.e. first running surface), can be formed at the edge of a first projection that projects away from the main body and into the junction between the first rail and the trailing rail (i.e. second rail). The trailing running surface (i.e. second running surface) can be formed directly at an edge of the main body that projects into the junction with a radiused junction forming a smooth radius between the first running surface and the second running surface.

The inventor discovered that he could further enhance the smooth movement of the movable panels at the juncture between overhead rails by having the trailing running surface project into the second overhead rail (i.e. the trailing overhead rail). This would be particularly helpful at steep transitions, for example, at or near right-angles. Here, a second projection projects from the main body into the second overhead rail. The second running surface is formed along an inward facing edge of the second projection. This arrangement, gives the roller guide and operable carrier a longer transition length and helps provide for a smoother transition.

To account for tolerances between the junction of one overhead rail and another, the main body is captive and slides within the first rail. This adjusts the distance of the second running surface from the length-wise axis of the second overhead rail. This allows the second running surface to be positioned tangent to the outer circumference to the roller guide. This is particularly helpful where the overhead rails are assembled by cutting and welding, which can create tolerance issues and variations at the rail junctures.

The inventor envisions that the movable panels of his movable partition system can be any movable partitions such as solid wood panels, infill panels, or glazed infill panels. In addition, the inventor envisions that his movable partitions can be sliding, slidable folding partitions, or a combination of sliding and slidable folding partitions. For example, sliding folding panels can fold, and latch together by a door catch, door latch, or other latching device and then slide together as a single folded unit. In addition, the inventor envisions his movable partition system to include a path guide at each rail-to-rail juncture or alternative path guides only at select rail-to-rail junctures. For example, for a given pair of junctures there could be a path guide only at a first juncture (for example the first juncture encountered by the movable partition), only at the second juncture, or at both junctures. The inventor envisions that his movable partition system could include a multi-path overhead guide rails in combination with bottom guide rails or multi-path overhead guide rails. One of the advantages of the inventor's movable partition system is that the bottom guide rail is optional. The overhead guide rails in combination with the inventor's novel path guides can allow the movable partition to move smoothly without the need of a bottom rail guide system.

This Summary introduces a selection of concepts in simplified form that are described in the Description. The Summary is not intended to identify essential features or limit the scope of the claimed subject matter.

DRAWINGS

DESCRIPTION

The terms "left," "right," "top, "bottom," "upper," "lower," "front," "back," and "side," are relative terms used throughout the to help the reader understand the figures. Unless otherwise indicated, these do not denote absolute direction or orientation and do not imply a particular preference. When describing the figures, the terms "top," "bottom," "front," "rear," and "side," are from the perspective of outside of the opening looking in. Specific dimensions are intended to help the reader understand the scale and advantage of the disclosed material. Dimensions given are typical and the claimed invention is not limited to the recited dimensions.

Figure 1:
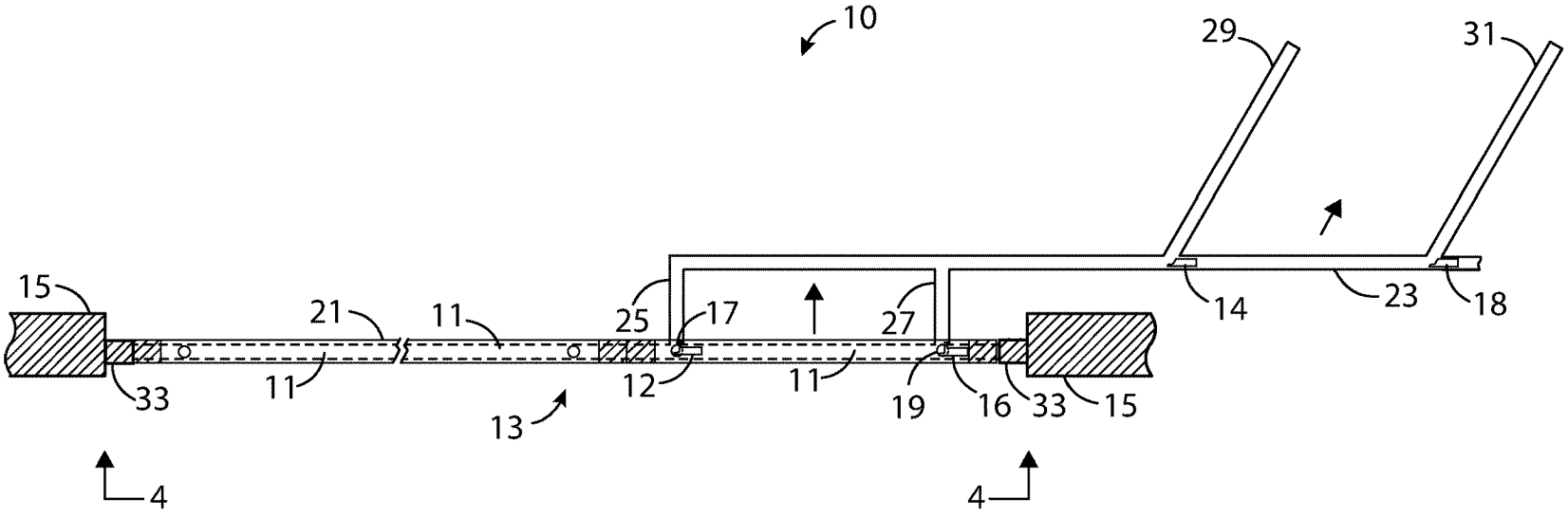
FIG. 1 illustrates a top plan view of a movable partition system of the present disclosure with the movable panels in the closed position.
Figure 2:
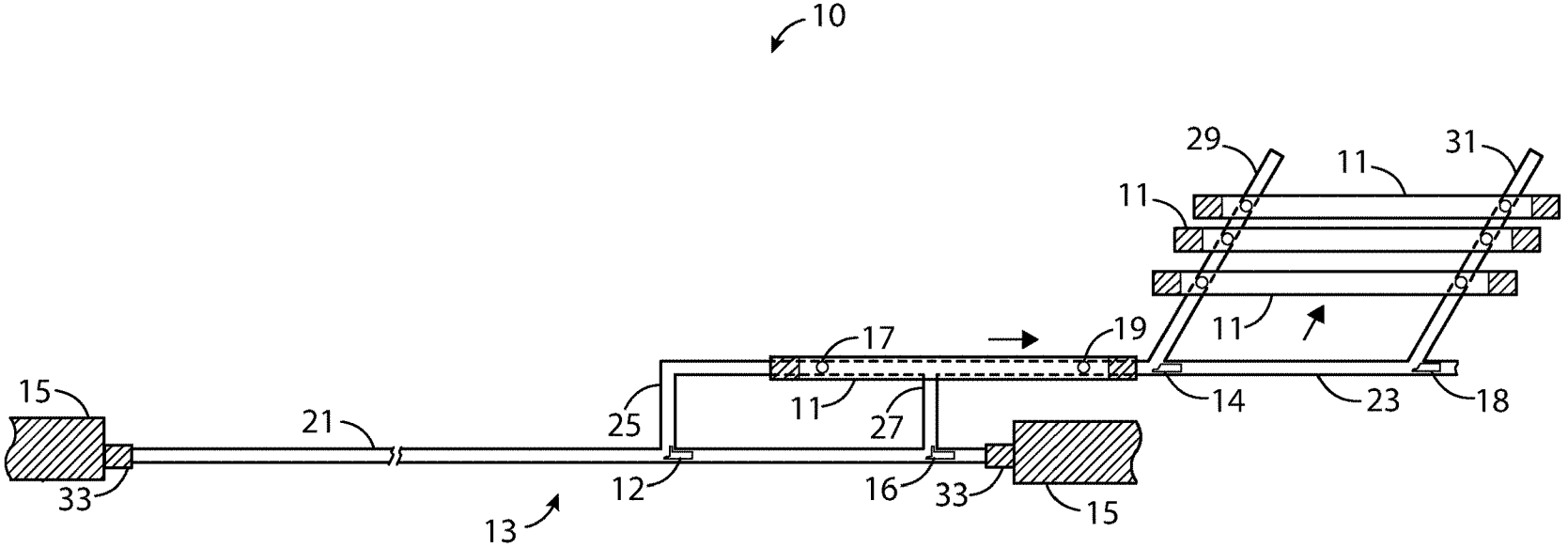
FIG. 2 illustrates the top plan view of FIG. 1 with the movable panels positioned between closed and open.
Figure 3:
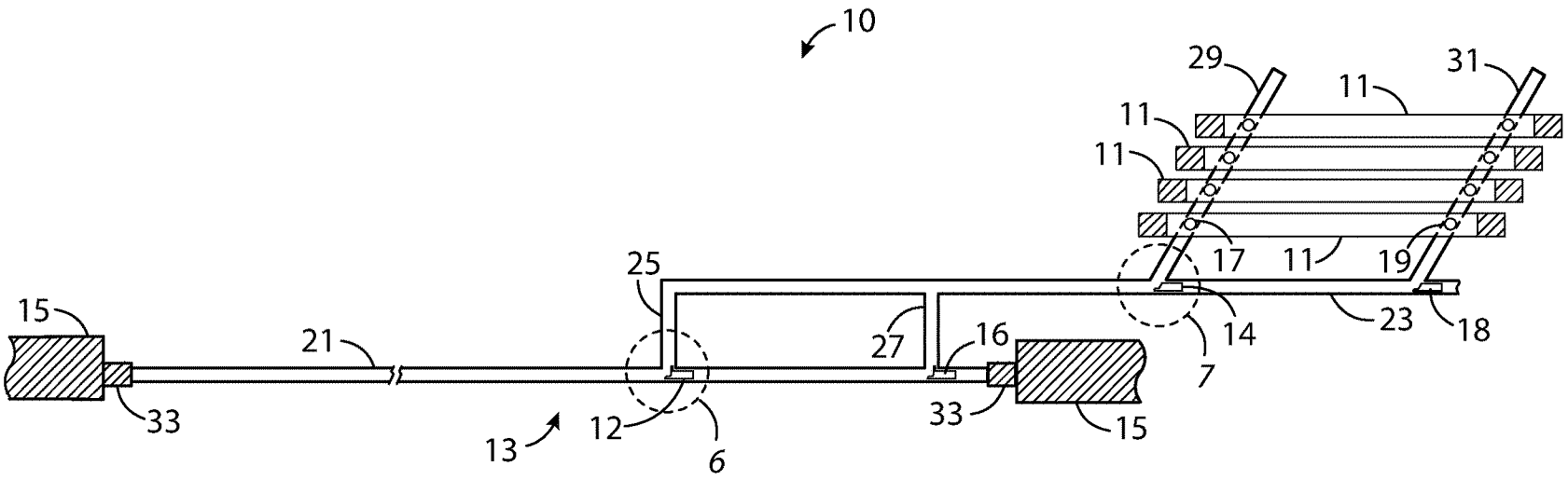
FIG. 3 illustrates the top plan view of FIG. 1 with the movable panels in the open position outside of the fenestration opening.
Figure 4:
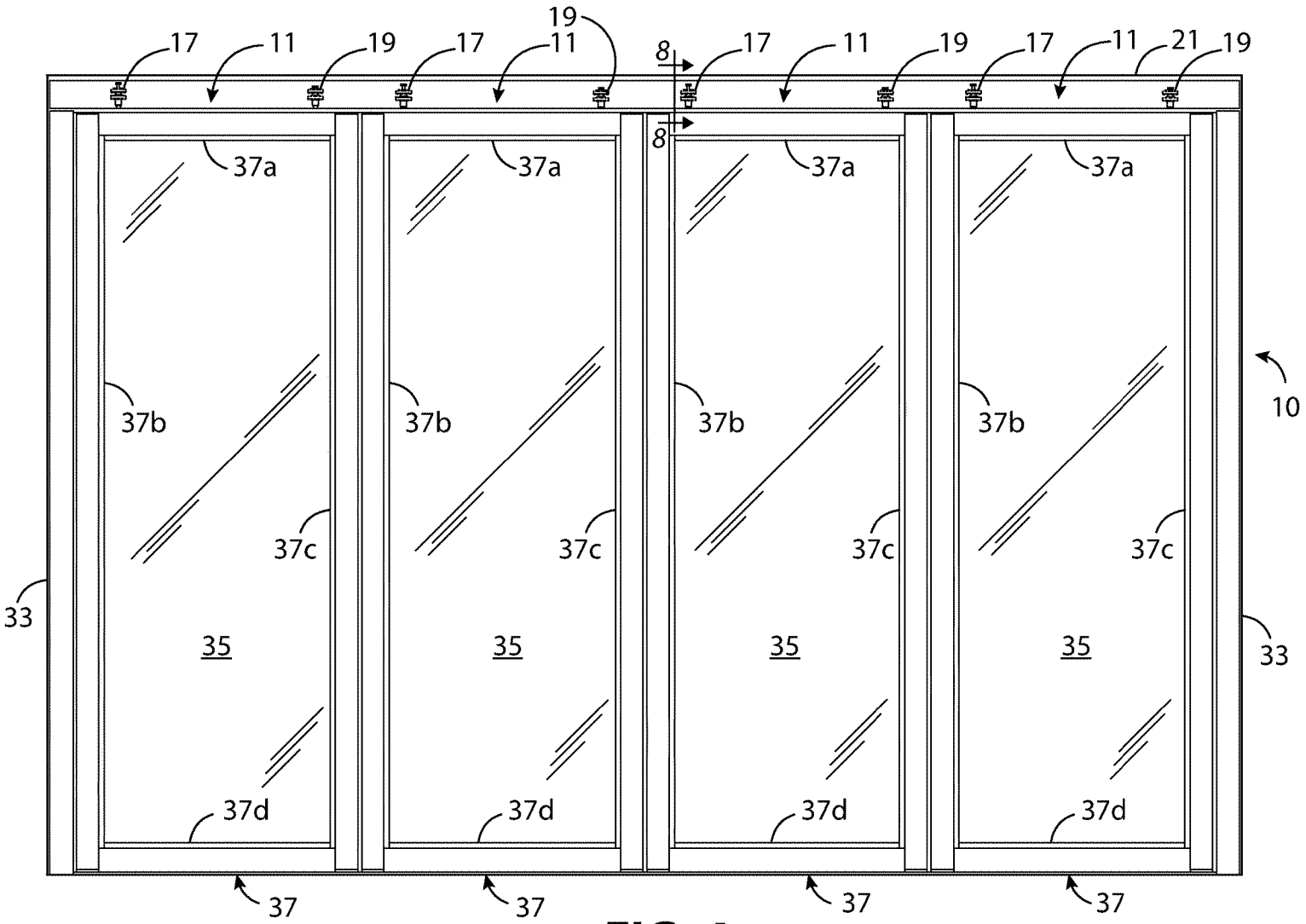
FIG. 4 illustrates a front elevation view of FIG. 1 taken along lines 4-4.

The following description is made with reference to figures, where like numerals refer to like elements throughout the several views, FIG. 1 illustrates a top plan view of a movable partition system 10 of the present disclosure with the movable panels 11 in the closed position within the fenestration opening 13. FIG. 2 illustrates the top plan view of the movable partition system 10 of FIG. 1 with the movable panels 11 positioned mid-way between opened and closed. FIG. 3 illustrates the top plan view of the movable partition system 10 of FIG. 1 with the movable panels 11 in the open position positioned behind the wall 15 and outside of the fenestration opening 13. FIG. 4 illustrates a front elevation view of the movable partition system 10 taken along section lines 4-4 from FIG. 1 and showing the movable panels 11 and operable carriers 17, 19 extending upward from the movable panels 11. The movable panels 11 can be any movable partitions such as solid wood panels, infill panels, or glazed infill panels. For example, sliding glass doors, sliding non-glazed doors, sliding windows, curtain walls, exterior partitions, interior partitions, folding glass doors, folding non-glazed doors, or folding windows. Alternatively, a combination sliding and folding glass door assembly, window assembly, or curtain wall assembly, sliding and folding non-glazed partitions such as wood, metal partitions and the like. For simplicity, the infill panels illustrated throughout this disclosure are illustrated as glazed infill panels.

Referring to FIGS. 1-3, the movable panels 11 guided by path guides 12, 14, 16, 18 as they slide along overhead rails 21, 23, 25, 27, 29, 31 by the operable carriers 17, 19. Overhead rail 21 is illustrated positioned between vertical jambs 33 on opposing ends of the fenestration opening 13. Overhead rail 23 is illustrated positioned parallel to overhead rail 21 on one side of the fenestration opening 13 and extending behind one side of the wall 15. Overhead rails 25, 27 join the overhead rail 21, 23 to each other with overhead rails 25, 27 positioned parallel to each other and spaced to allow the movable panels 11 to travel between overhead rails 25, 27 via the operable carriers 17, 19. Overhead rail 23 is joined to overhead rails 29, 31 with overhead rails 29, 31 spaced and parallel to each other so that the movable panels 11 can travel along overhead rails 29, 31 as shown in FIGS. 2 and 3.

Referring to FIG. 4, the movable panels 11 are illustrated with an infill panel 35, such as a glass panel, surrounded by sash 37. The sash 37 can include a top rail 37*a*, vertical stiles 37*b*, 37*c*, and a bottom rail 37*d* surrounding the infill panel 35. Alternatively, the movable panels 11 can be solid wood, or any other material suitable for the particular application. For example, in some applications where the fenestration opening 13 of FIGS. 1-3 go from an exterior environment to an interior environment, the construction of the movable panels 11 and the vertical jambs 33 surrounding the fenestration opening 13 should be suitable for this purpose. In FIG. 4, the overhead rail 21 together with the vertical jambs 33 form the fenestration frame. As further illustrated in FIG. 8, the overhead rail 21 can be surrounded by a cover 38 to create a unified appearance with the vertical jambs 33. Referring back to FIG. 4, the operable carriers 17, 19 are shown projecting out of the top rail 37*a*. The operable carriers 17, 19 are shown spaced apart and positioned near vertical stiles 37*b*, 37*c* on opposite sides of the infill panel 35. The operable carriers 17, 19 are illustrated in broken line to represent that they are hidden within the overhead rail 21.

Figure 5:
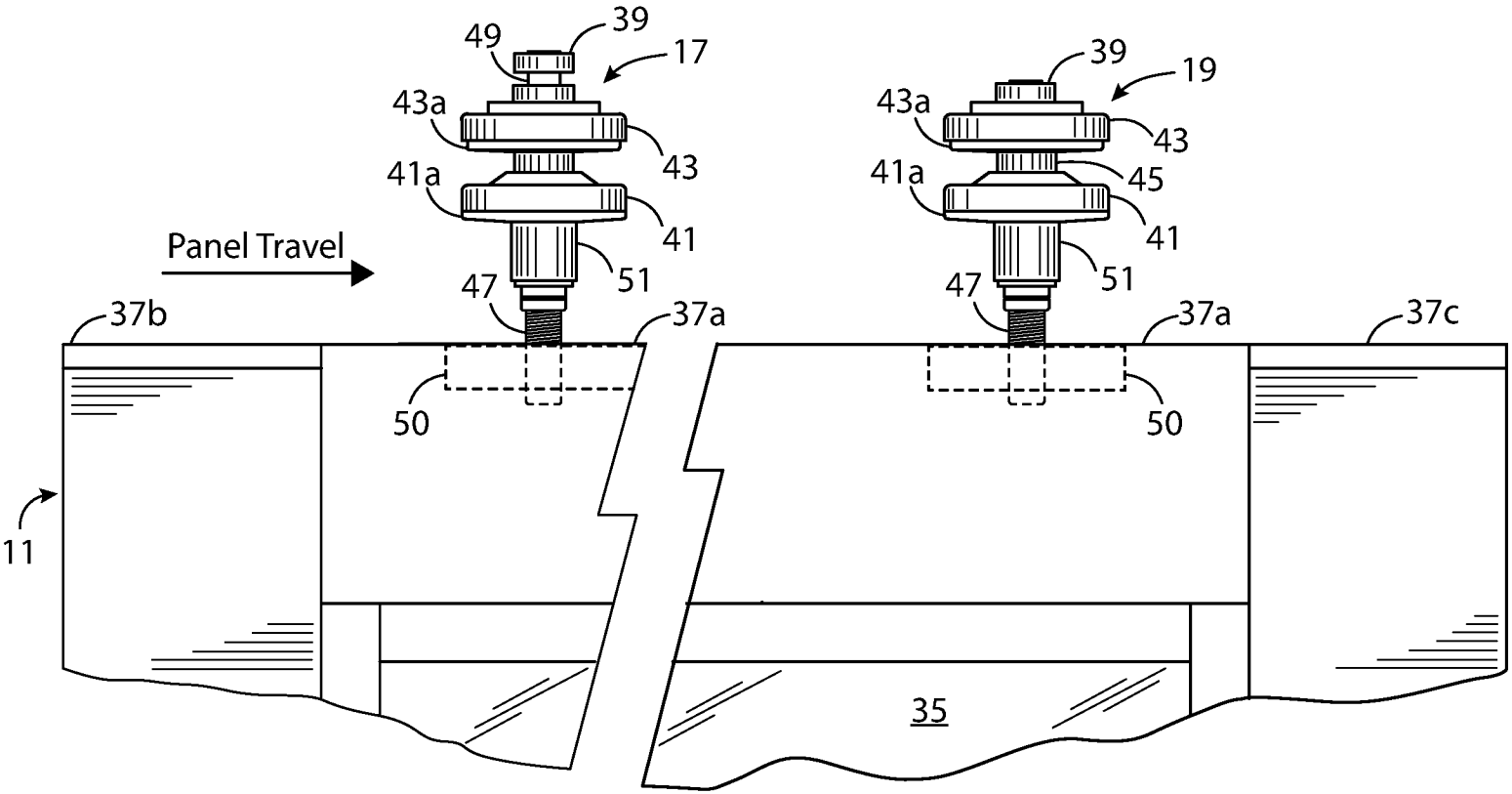
FIG. 5 illustrates an enlarged view of the top of a movable panel of FIG. 4 showing the movable carriers attached to the top rail of the sash.

FIG. 5 illustrates an enlarged view of the top of the movable panel 11 of FIG. 4 showing the operable carriers 17, 19 attached to the top rail 37*a*. The position of the operable carriers 17, 19 are shown in relation to the vertical stiles 37*b*, 37*c*. The operable carrier 17 is shown proximate to vertical stile 37*b* and the operable carrier 19 is shown positioned proximate to the vertical stile 37*c*. Mounting the operable carriers 17, 19 wide apart, as illustrated helps distribute the weight of the movable panel 11, which can be quite significant, especially when the infill panel 35 is a double pane or triple pane glass or other insulated glazing unit (IGU). The operable carriers 17, 19 can be identically constructed, as illustrated, with the difference being the position of guide roller 39.

Figure 9:
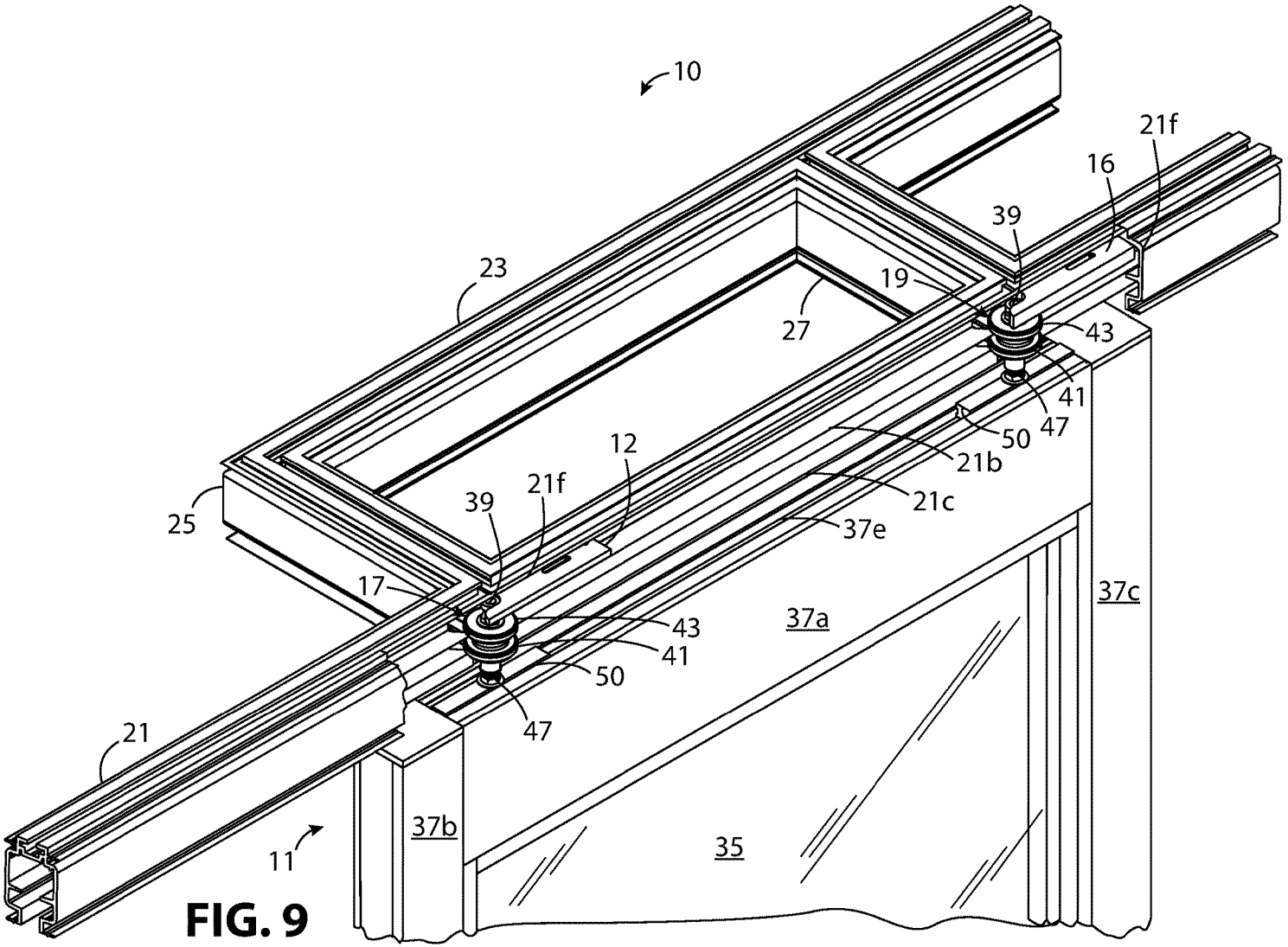
FIG. 9 illustrates a portion of the movable partition system of FIG. 1 in top and front perspective view and in partial front-cutaway.
Figure 10:
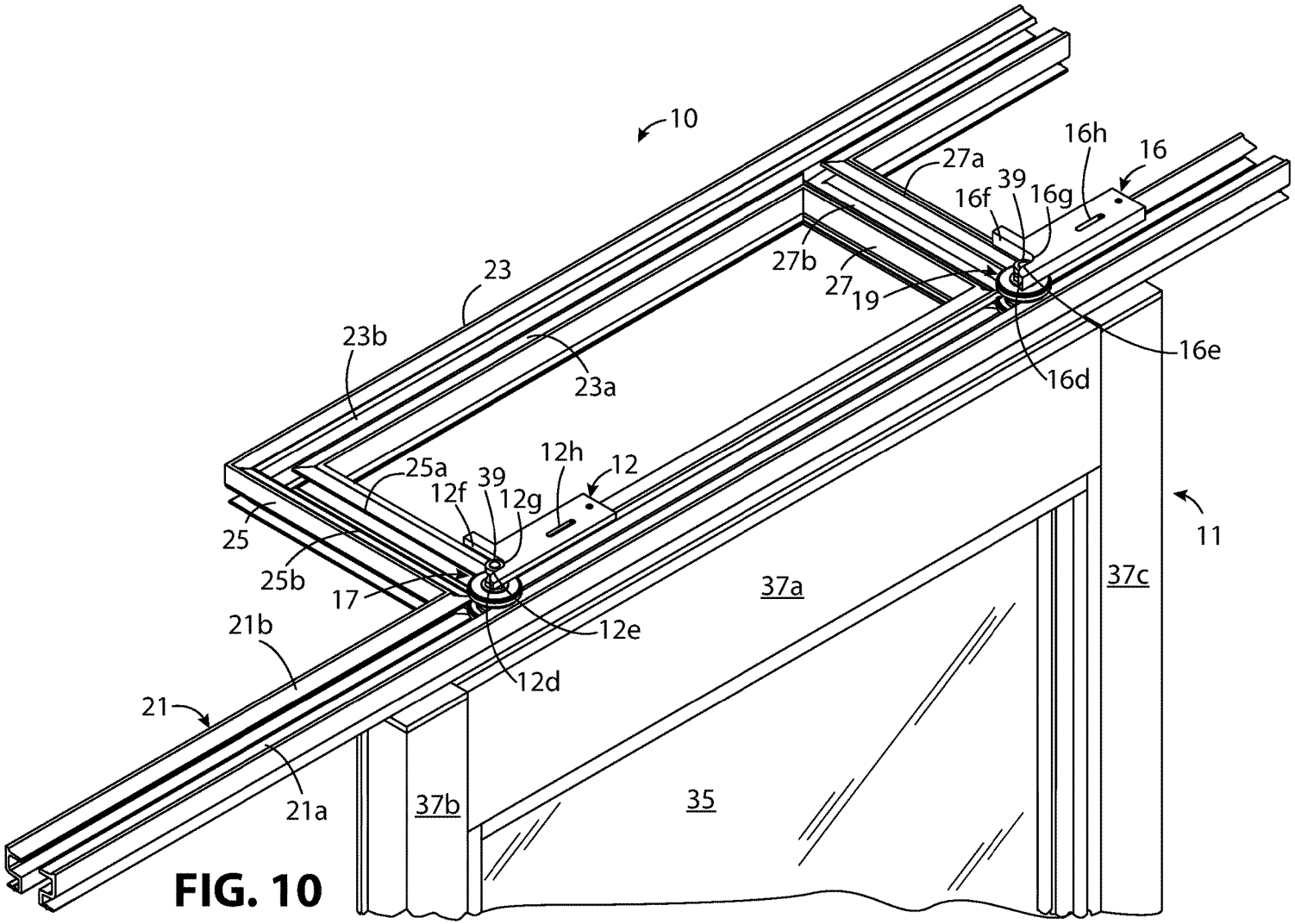
FIG. 10 illustrates the portion of the movable partition system of FIG. 9 in top and front perspective view and in top-cutaway.
Figure 11:
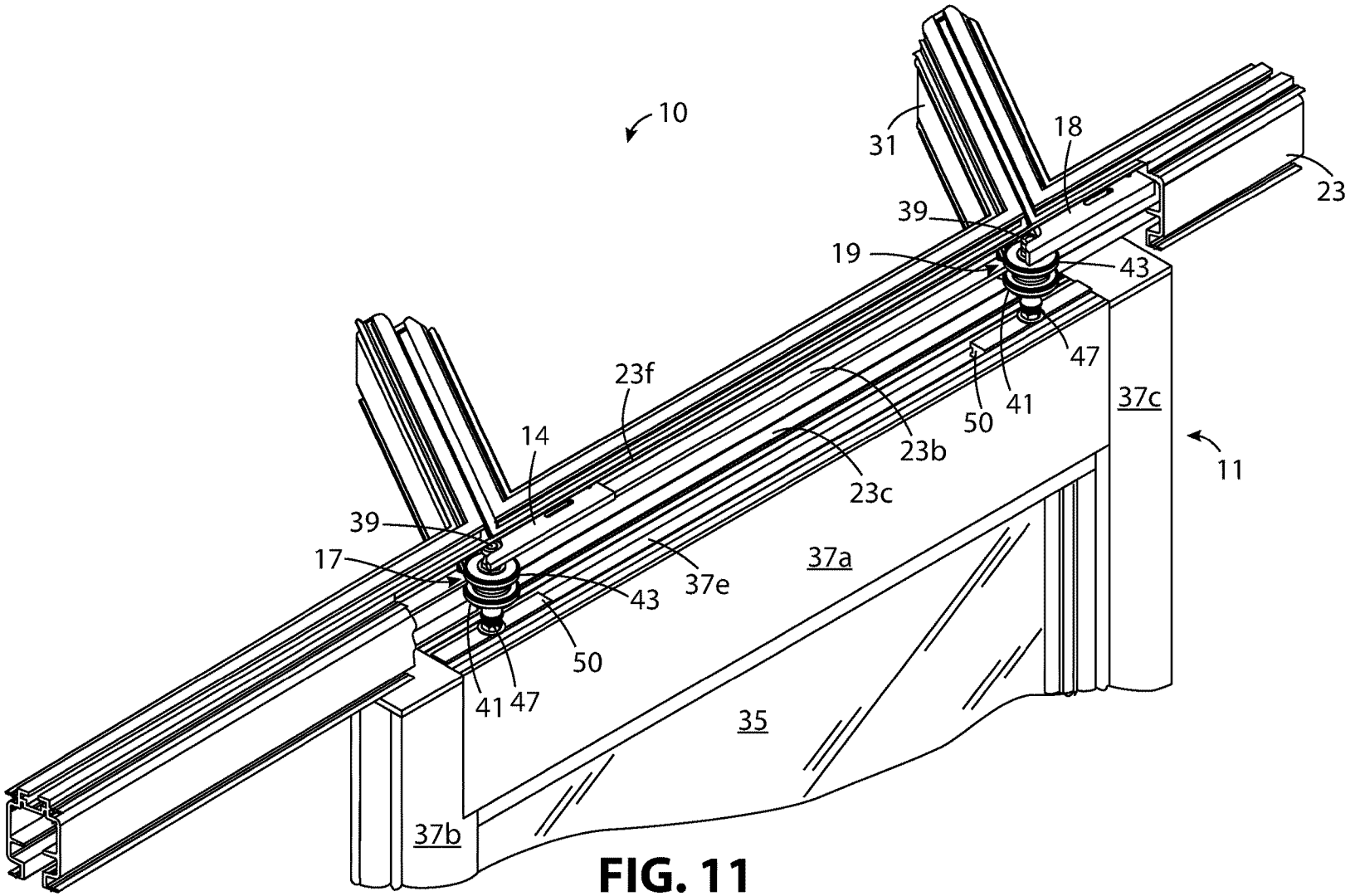
FIG. 11 illustrates a portion of the movable partition system of FIG. 1 in top and front perspective view and in partial front-cutaway.
Figure 12:
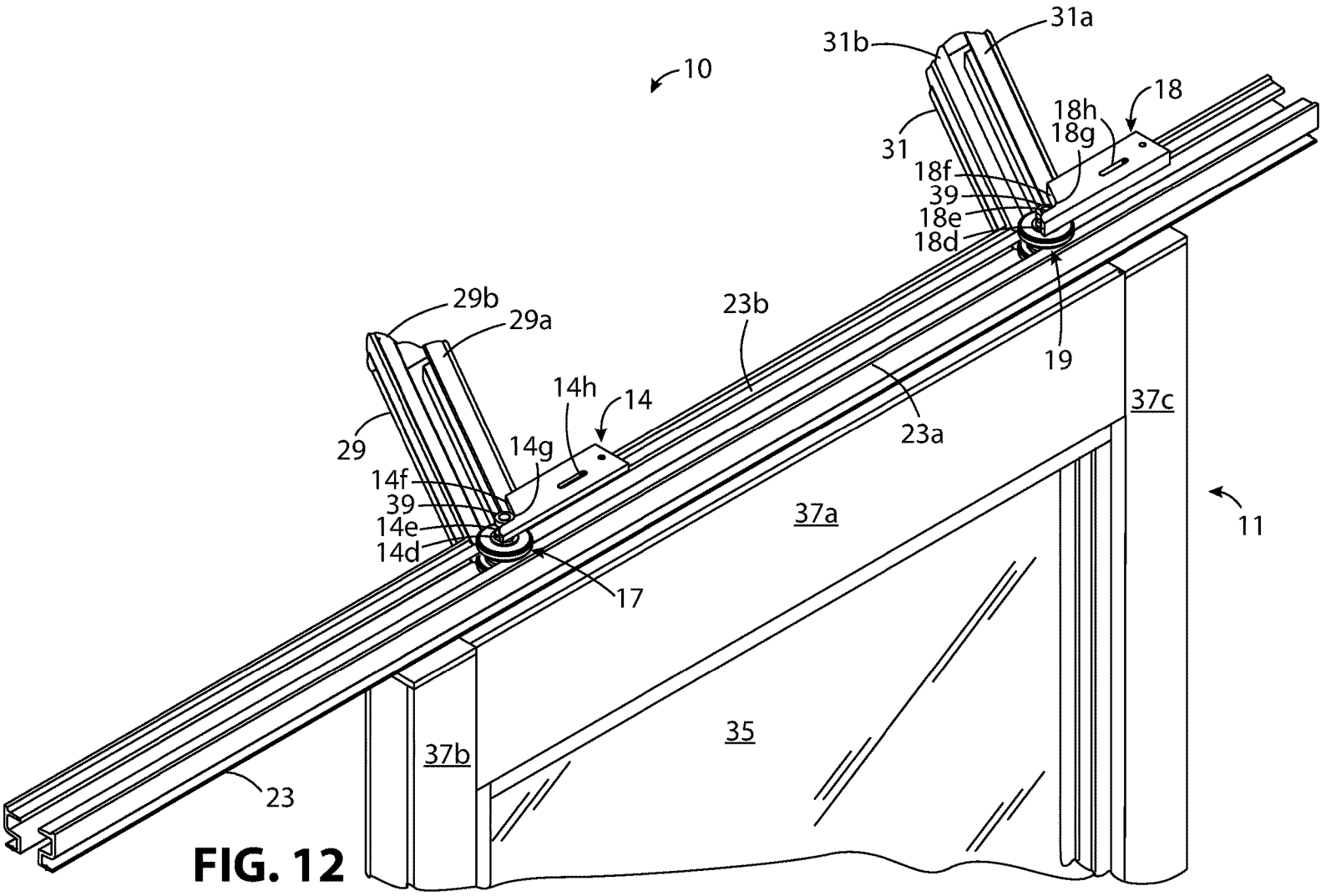
FIG. 12 illustrates the portion of the movable partition system shown in FIG. 9 in top and front perspective view and in top-cutaway.

Referring to FIGS. 2 and 5, the guide roller 39 (FIG. 5) is positioned on the operable carrier 19 so it passes under path guides 12, 14 (FIG. 2) unimpeded, while being guided by path guides 16, 18 (FIG. 2). The guide roller 39 (FIG. 5) extends upward from operable carrier 17 and is positioned so it is guided by path guides 12 (FIG. 2) on overhead rail 21 (FIG. 2) and is guided by path guide 14 (FIG. 2) on overhead rail 23 (FIG. 2). Note that in order for the path guides 12, 14, 16, 18 (FIG. 2) to work in combination with operable carriers 17, 19 as described, path guide 12 (FIG. 2) and path guide 14 (FIG. 2) can be identical except for thickness, i.e. path guide 16 (FIG. 2) would be thicker than path guide 12 (FIG. 2). Similarly, path guide 18 (FIG. 2) would be thicker than path guide 14 (FIG. 2). Path guides 16, 18 (FIG. 2) would have sufficient thickness compared with path guides 12, 14 (FIG. 2) to catch and direct their guide rollers 39 (FIG. 5). FIGS. 9 and 10 illustrate path guide 12 and path guide 16 have different thickness in order to accommodate the height of the guide roller 39 of operable carrier 19. Similarly, FIGS. 11 and 12 illustrate path guide 14 and path guide 18 have different thickness in order to accommodate the height of guide roller 39 of operable carrier 19.

The inventor observed that sliding the movable panels 11, especially heavy glass door panels, can be difficult at the junctures between one overhead rail and another. This can cause particular challenges at right-angle or approximately right-angle junctures, for, example, at the juncture between overhead rail 21 and overhead rail 25 or between overhead rail 21 and overhead rail 27 as illustrated in FIGS. 1-3. The inventor discovered that he could create a much smoother transition at junctures between one overhead rail and another by creating path guides, such as path guides 12, 14, 16, 18 that include leading and trailing running surfaces (i.e. leading and trailing guide roller engaging surfaces) that engage self-centering guide rollers, such the guide rollers 39, along paths tangent to the edge of the guide rollers 39. This minimizes the resistance to movement encountered in other path guides. In addition, to further minimize resistance, the leading edge of the leading running surface can be radiused or tapered to gently guide the self-centering roller guide back to center. This principle will be described in more detail in the discussion of FIGS. 6-8.

Figure 6:
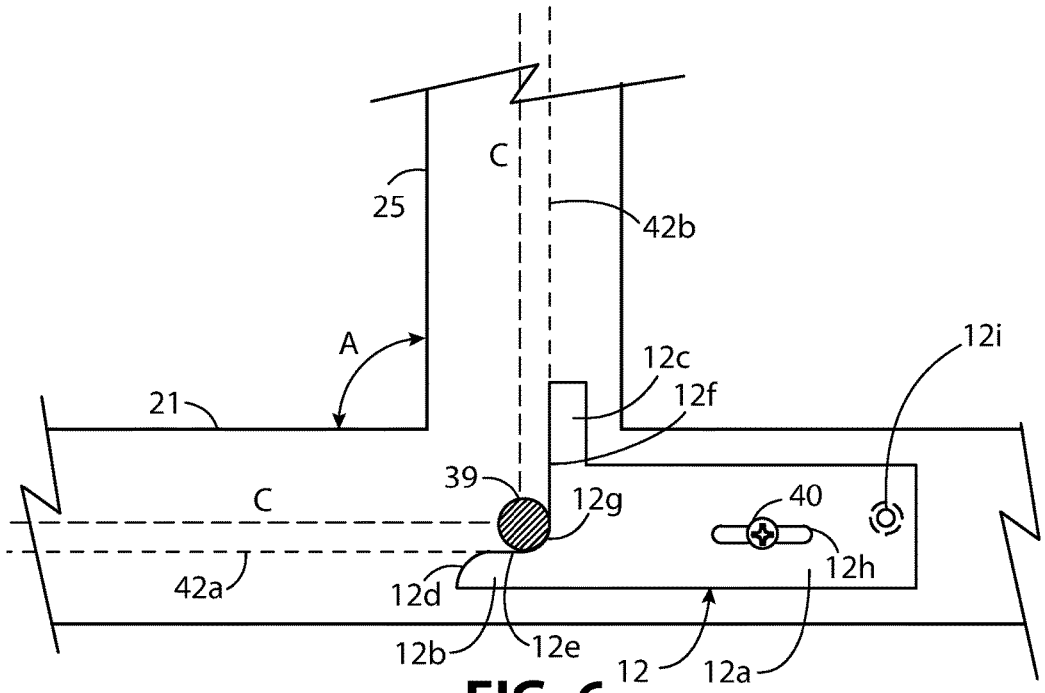
FIG. 6 illustrates an enlarged view of a portion of FIG. 1 showing a first path guide.
Figure 8:
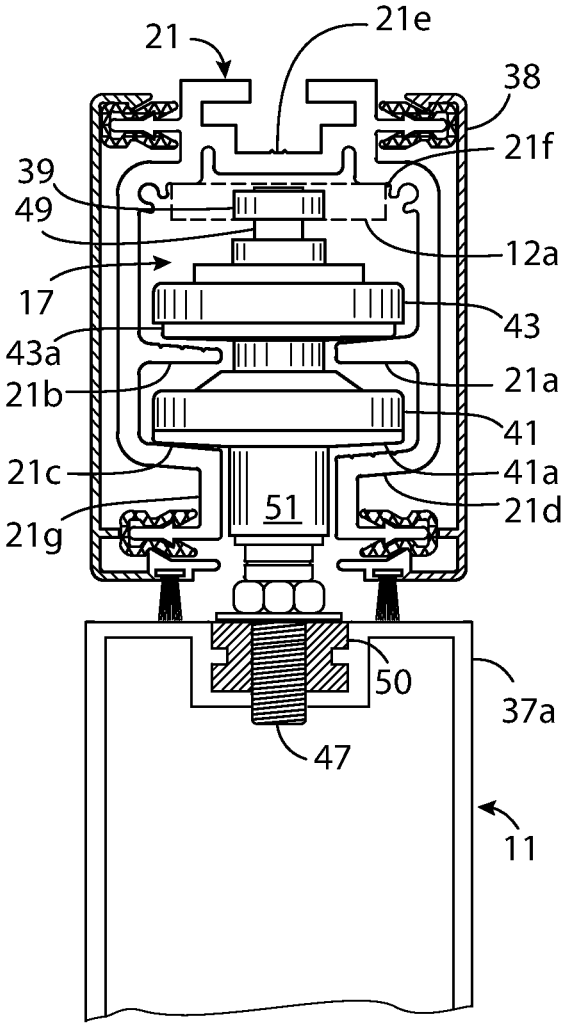
FIG. 8 illustrates a section view of FIG. 4 taken along section lines 8-8.

FIG. 6 illustrates an enlarged view of a portion of FIG. 1, taken at detail 6 and showing path guide 12 in detail within the junction of overhead rails 21 and overhead rails 25. The path guide 12 includes a main body 12*a*, a first projection 12*b*, a second projection 12*c*, a leading edge 12*d* of the first projection 12*b*, a first running surface 12*e*, a second running surface 12*f*, a radiused junction 12*g* between the first running surface 12*e* and the second running surface 12*f*, and a slot 12*h* in the main body 12*a*. The path guide 12 can be secured to the overhead rail 21 by a combination of a threaded fastener 40 through the overhead rail top 21*e* of FIG. 8 and through the slot 12*h*. The threaded fastener 40 can be a screw, bolt, combination of a screw or bolt and nut, or any threaded fastener suitable for adjustably and removably securing the path guide 12 to the overhead rail 21. The main body 12*a* can be substantially rectangular, or alternatively have a pair of parallel length-wise edges, so its position can be constrained to be slidably move length-wise along the overhead rail 21. As illustrated in FIG. 8, the rectangular shape of the main body 12*a* in combination with the slotted surface 21*f* on the inside upper portion of the overhead rail 21 can be constructed to constrain movement of the main body 12*a* to only slide longitudinally along the slotted surface 21*f*. A perspective view of the path guide 12 along with the leading edge 12*d*, the first running surface 12*e*, the second running surface 12*f*, the radiused junction 12*g*, and the slot 12*h* is illustrated in FIG. 10. In addition, the path guide 16, which is substantially identical to the path guide 12 except for thickness, along with the leading edge 16*d*, the first running surface 16*e*, the second running surface 16*f*, the radiused junction 16*g*, and the slot 16*h* is also illustrated in FIG. 10.

Referring to FIG. 6, the first projection 12*b* projects from the main body 12*a* length-wise along the overhead rail 21 and into the juncture between the overhead rails 21, 25. The first running surface 12*e* is formed along the inside edge of the first projection 12*b* and can run longitudinally along the overhead rail 21 parallel to the length-wise center line of the overhead rail 21. The second projection 12*c* can project from the main body 12*a* longitudinally (i.e. length-wise) into the overhead rail 25 from the juncture between the overhead rails 21, 25. The second running surface 12*f* is formed along the inside edge of the second projection 12*c* and can run length-wise along the overhead rail 25 parallel to the length-wise centerline C of the overhead rail 25. The first running surface 12*e* and the second running surface 12*f* are joined by the radiused junction 12*g*. The curve of the radiused junction 12*g* can be a circular section with a radius approximately equal to the outside circumference of the guide roller 39. This will help create a naturally smooth transition between the first running surface 12*e* and the second running surface 12*f* for the guide roller 39. The angle between the overhead rails 21, 25 is depicted by angle A. The angle between the first running surface 12*e* and the second running surface 12*f* is equal to angle A. In FIG. 6, angle A is shown as 90-degrees. However, it is possible that angle A can be greater than 90-degrees (i.e. obtuse) and the inventor envisions that the path guide 12, can be used where the angle A is 90-degrees or greater.

Continuing to refer to FIG. 6, the center of the guide roller 39 can be configured to move along the length-wise center line of the overhead rails 21, 25. The outside circumference of the guide roller 39, therefore moves along a path 42*a* within overhead rail 21 and a path 42*b* within overhead rail 25 that is parallel to the length-wise centerlines C of overhead rail 21 and overhead rail 25 respectively. In this configuration, the path guide 12 is sized and positioned so that the first running surface 12*e* is aligned along path 42*a* and the second running surface 12*f* is aligned along path 42*b*. This alignment assures that the first running surface 12*e* and the second running surface 12*f* tangent to the outside circumference of the guide roller 39. The inventor discovered that by positioning the path guide 12 so that the first running surface 12*e* is aligned along path 42*a* and the second running surface 12*f* is aligned along path 42*b*, the resistance of the movable panels 11 of FIGS. 1-4, can be significant reduced resulting in the possibility of the user expending less effort to move the movable panels 11 through the transition between overhead rails 21, 25. In addition, the inventor discovered on particularly steep transitions, such as the 90-degree transition between overhead rails 21, 25 in FIG. 6, extending the second running surface 12*f*, and therefore the second projection 12*c* into the overhead rail 25 further helped to reduce resistance and create a smooth transition.

The operable carriers 17, 19 of FIG. 5 are typically self-aligning, meaning that operable carriers 17, 19 will self-correct their position to stay substantially centered in their respective overhead rails 23, 25, 27, 29, 31 of FIGS. 1-3. As a result, the guide roller 39 will self-center. Referring again to FIG. 6, this means that while the guide roller 39 may wobble slightly as the movable panels 11 are slid, they will self-correct so that the tangent of the outer circumference of the guide roller 39 to move substantially along paths 42*a*, 42*b*. The inventor was able to take advantage of the self-centering tendency of the guide roller 39 by convexly radiusing the leading edge 12*d* of the first projection 12*b*. If the center of the guide roller 39 is moving on centerline C of overhead rail 21, the guide roller 39 will directly engage the first running surface 12*e* tangent to the outer circumference of the guide roller 39. In this scenario, the guide roller 39 has intersected the first running surface 12*e* will a minimal resistance. If the guide roller 39 has wobbled from center the outer circumference of the guide roller 39 will engage the leading edge 12*d* of the first projection 12*b*. Because the leading edge 12*d* is convexly radiused, it will push the guide roller 39 back to center causing the outer circumference to guide roller 39 the first running surface 12*e*.

In order to account for variances in the alignment of the overhead rails 21, 25 during assembly, the position of the second running surface 12*f* can be adjusted to align along path 42*b* by loosening the threaded fastener 40 and moving the path guide 12 along slot 12*h*. Optionally, after alignment, in order to further affix the path guide 12 to the overhead rail 21, a hole can be drilled into both the top of the overhead rail 21 and into the main body 12*a*, for example, at position 12*i*, with the two holes secured by a threaded fastener.

Figure 7:
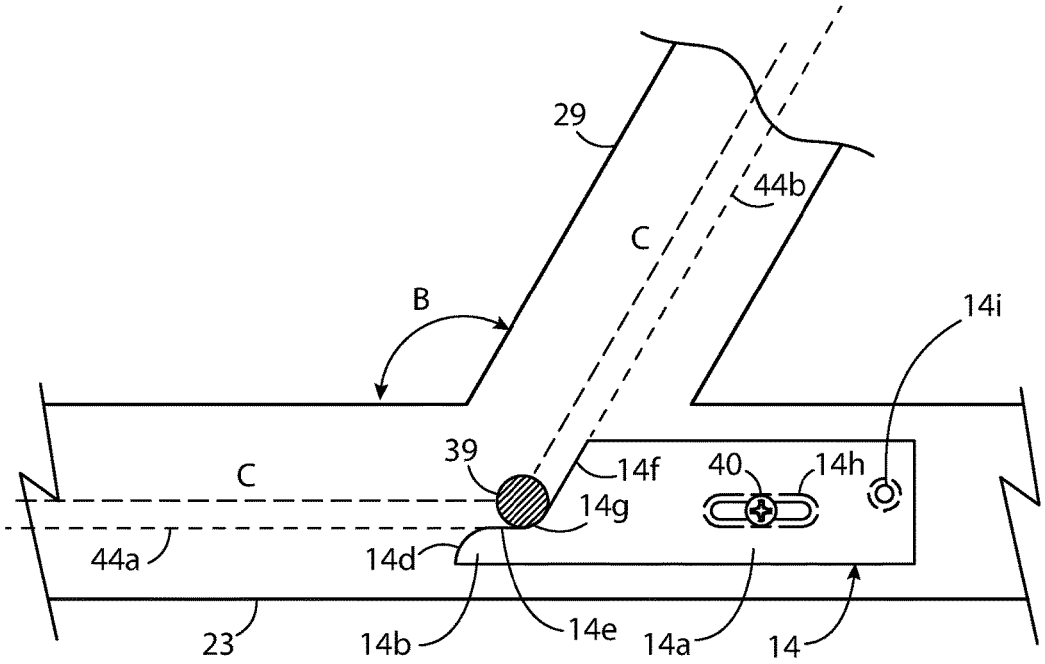
FIG. 7 illustrates an enlarged view of a portion of FIG. 1 showing a second path guide.

While the path guide 12 of FIG. 6 can typically be used where angle A is 90-degrees or greater, for obtuse angles with less resistance to movement, such as the junction between overhead rails 23 and overhead rail 29 or between overhead rail 23 and overhead rail 31 of FIGS. 1-3, the second projection 12*c* of FIG. 6 may not be necessary. FIG. 7 illustrates an enlarged view of a portion of FIG. 1, at detail 7, showing the path guide 14 in detail within the junction of overhead rails 23 and overhead rails 29. The path guide 14 of FIG. 7 is similarly constructed as the path guide 12 of FIG. 6 except for the elimination of second projection 12*c* of FIG. 6. The path guide 14 includes a main body 14*a*, a first projection 14*b*, a leading edge 14*d* of the first projection 14*b*, a first running surface 14*e*, a second running surface 14*f*, a radiused junction 14*g* between the first running surface 14*e* and the second running surface 14*f*, and a slot 14*h* in the main body 14*a*. The path guide 14 can be secured to the overhead rail 23 by a threaded fastener 40 through the overhead rail top 21*e* (as in FIG. 8), as similarly described for FIG. 6, and through the slot 14*h*. The threaded fastener 40 can be a screw, bolt, combination of a screw or bolt and nut, or any threaded fastener suitable for adjustably and removably securing the path guide 14 to the overhead rail 23. The main body 14*a* can be substantially rectangular in shade so its position can be constrained to be slidably adjustable only longitudinally, or length-wise, along the overhead rail 23. As described for FIG. 6 when referring to FIG. 8, the rectangular shape of the main body 14*a* in combination with the slotted surface 21*f* on the inside upper portion of the overhead rail 23 can be constructed to constrain movement of the main body 14*a* to only slide longitudinally along the slotted surface 21*f*. A perspective view of the path guide 14 along with the leading edge 14*d*, the first running surface 14*e*, the second running surface 14*f*, the radiused junction 14*g*, and the slot 14*h* is illustrated in FIG. 12. In addition, the path guide 18, which is substantially identical to the path guide 14 except for thickness, as illustrated, along with the leading edge 18*d*, the first running surface 18*e*, the second running surface 18*f*, the radiused junction 18*g*, and the slot 18*h* is also illustrated in FIG. 12.

Referring back to FIG. 7, the first projection 14*b* projects from the main body 14*a* length-wise along the overhead rail 23 and into the juncture between the overhead rails 23, 29. The first running surface 14*e* is formed along the inside edge of the first projection 14*b* and can run length-wise along the overhead rail 23 parallel to the length-wise center line of the overhead rail 23. The second running surface 14*f* is formed along a portion of one end of the path guide 14. The second running surface 14*f* can run parallel to the length-wise centerline C of the overhead rail 29. The first running surface 14*e* and the second running surface 14*f* are joined by the radiused junction 14*g*. The curve of the radiused junction 14*g* can be a circular section with a radius equal to the outside circumference of the guide roller 39. This will help create a naturally smooth transition between the first running surface 14*e* and the second running surface 14*f* for the guide roller 39. The angle between the overhead rails 23, 29 is depicted by angle B. The angle between the first running surface 14*e* and the second running surface 14*f* is equal to angle B. In FIG. 7, angle B is shown as 120-degrees, however, angle B can in general be any obtuse angle.

The center of the guide roller 39 can be configured to move along the length-wise center line of the overhead rails 23, 29. The outside circumference of the guide roller 39, therefore moves along a path 44*a* within overhead rail 23 and a path 44*b* within overhead rail 29 that is parallel to the length-wise centerlines C of overhead rail 23 and overhead rail 29 respectively. In this configuration, the path guide 14 is sized and positioned so that the first running surface 14*e* is aligned along path 44*a* and the second running surface 14*f* is aligned along path 44*b*. This alignment assures that the first running surface 14*e* and the second running surface 14*f* tangent to the outside circumference of the guide roller 39. The inventor discovered that by positioning the path guide 14 so that the first running surface 14*e* is aligned along path 44*a* and the second running surface 14*f* is aligned along path 44*b*, the resistance of the movable panels 11 of FIGS. 1-4, can be significant reduced resulting in the possibility of the user expending less effort to move the movable panels 11 through the transition between overhead rails 23, 29 and likewise, through overhead rails 23, 31.

The operable carriers 17, 19 of FIGS. 1-5 are typically self-aligning, as previously described and the guide roller 39 will self-center. Referring again to FIG. 7, this means that while the guide roller 39 may wobble slightly as the movable panels 11 are slid, they will self-correct so that the tangent of the outer circumference of the guide roller 39 to move substantially along paths 44*a*, 44*b*. As described for FIG. 6, for the path guide 14 of FIG. 7, the inventor was able to take advantage of the self-centering tendency of the guide roller 39 by convexly radiusing the leading edge 14*d* of the first projection 14*b*. If the center of the guide roller 39 is moving on centerline C of overhead rail 23, the guide roller 39 will directly engage the first running surface 14*e* tangent to the outer circumference of the guide roller 39. In this scenario, the guide roller 39 has intersected the first running surface 14*e* will a minimal resistance. If the guide roller 39 has wobbled from center the outer circumference of the guide roller 39 will engage the leading edge 14*d* of the first projection 14*b*. Because the leading edge 14*d* is convexly radiused, it will push the guide roller 39 back to center causing the outer circumference to guide roller 39 the first running surface 14*e*.

In order to account for variances in the alignment of the overhead rails 23, 29 during assembly, the position of the second running surface 14*f* can be adjusted to align along path 44*b* by loosening the threaded fastener 40 and moving the path guide 14 along slot 14*h*. Optionally, after alignment, in order to further affix the path guide 14 to the overhead rail 23, a hole can be drilled into both the top of the overhead rail 23 and into the main body 14*a*, for example, at position 14*i*, with the two holes secured by a threaded fastener.

The operable carriers 17, 19 will now be described in more detail. FIG. 5 shows both the operable carries 17, 19 while FIG. 8 shows operable carrier 17 in context of the overhead rail 21. Referring to FIGS. 5 and 8, The operable carriers 17, 19 include the guide roller 39, lower helical bearing 41 with a lower bearing lower surface 41*a*, upper helical bearing 43, with an upper bearing lower surface 43*a*, a spacer 45 between the upper helical bearing 43 and the lower helical bearing 41, a threaded fastener 47 that secures the operable carriers 17, 19 to the top rail 37*a* of the movable panel 11 via insert 50. The guide roller 39 can rotate about a spindle 49 on bearings. Alternatively, the guide roller 39 can be fixed to the spindle 49, and the spindle 49 and guide roller 39 together may rotate around a bearing either on top of or within the upper helical bearing 43. A bearing 51 below the lower helical bearing 41 can be configured to rotate independently from the lower helical bearing 41. The upper helical bearing 43, the lower helical bearing 41, the bearing 51, and the guide roller 39 can be horizontally positioned and rotate about a vertical axis.

Referring to FIG. 8, both the upper bearing lower surface 43*a* and the lower bearing lower surface 41*a* are tapered downward. First projection 21*a*, second projection 21*b*, third projection 21*c*, and fourth projection 21*d* project inward and are tapered downward toward the center of the overhead rail 21. The first projection 21*a*, second projection 21*b*, third projection 21*c*, fourth projection 21*d*, lower bearing lower surface 41*a*, and upper bearing lower surface 43*a* are tapered so that the upper helical bearing 43 and the lower helical bearing 41 rest on opposing inside surfaces of the overhead rail 21. The lower bearing lower surface 41*a* rest on the third projection 21*c* while the upper bearing lower surface 43*a* rests on the first projection 21*a*. The upper helical bearing 43 and the lower helical bearing 41 are disposed to rotate in opposite directions. This arrangement causes the operable carriers 17 to self-center. As the operable carrier 17 shifts to one side or the other, the downward taper of the first projection 21*a*, the second projection 21*b*, the third projection 21*c*, and the fourth projection 21*d* in combination with the inward taper of the upper bearing lower surface 43*a* and the lower bearing lower surface 41*a* will cause the operable carrier 17 to re-center itself. In addition, bearing 51 is tightly coupled to the inside surface of the throat 21*g* of the overhead rail 21, and this limits the extent of the movement of the upper helical bearing 43 and the lower helical bearing 41 from side to side.

While the operable carriers 17, 19 are illustrated using a pair of helical bearings as shown in FIGS. 5 and 8, the movable partition system 10 is not limited to such an arrangement. Other self-centering overhead carriers that utilize a horizontal guide roller rotatable about a vertical axis can be utilized. For example, the carriers illustrated in U.S. Pat. No. 3,879,799 "Multidirectional Suspension System for Operable Partitions," (Williams) and U.S. Pat. No. 5,230,123, "Operable Wall Deployment and Storage System" (Williams). In addition, systems with self-aligning horizontal roller that engage inside projected surfaces of the overhead rails can be used.

FIGS. 9 and 10 illustrate the movable partition system 10 with path guides 12, 16 in relationship with overhead rails 21, 23, 25, 27 in two different perspective cutaway views. FIG. 9 illustrates a portion of FIG. 1 in top and front perspective and in partial-cutaway view. FIG. 10 illustrates a portion of FIG. 1 in top and front perspective and in top-cutaway view. Referring to FIGS. 9 and 10, path guides 12, 16 can both positioned against the slotted surface 21*f* (FIG. 9). However, path guide 16 is thicker than path guide 12 allowing the guide roller 39 of the operable carrier 19 to pass under path guide 12 but to engage path guide 16. FIG. 9 shows the relationship between the upper helical bearing 43 and the second projection 21*b* of overhead rail 21 as well as the relationship between the lower helical bearing 41 and the third projection 21*c*. FIG. 10 illustrates the relationship between the operable carriers 17, 19 and the first projections 21*a*, 23*a*, 25*a*, 27*a* of overhead rails 21, 23, 25, 27 respectively. FIG. 10 also illustrates the relationship between the operable carriers 17, 19 and the second projections 21*b*, 23*b*, 25*b*, 27*b* of overhead rails 21, 23, 25, 27 respectively. Both FIGS. 9 and 10 illustrate a top portion of the movable panel 11 in relationship to the overhead rails 21, 23, 25, 27. The top portion of the movable panel 11 is shown with the infill panel 35 surrounded by the top rail 37*a*, and vertical stiles 37*b*, 37*c*. In FIG. 9 the threaded fasteners 47 of the operable carriers 17, 19 are shown secured in a groove 37*e* in the top rail 37*a* via the insert 50.

FIGS. 11 and 12 illustrate the movable partition system 10 with path guides 14, 18 in relationship with overhead rails 21, 23, 25, 27 in two different perspective cutaway views. FIG. 11 illustrates a portion of FIG. 1 in top and front perspective and in partial-cutaway view. FIG. 12 illustrates a portion of FIG. 1 in top and front perspective and in top-cutaway view. Referring to FIGS. 11 and 12, path guides 14, 18 can both positioned against the slotted surface 23*f* (FIG. 11). However, path guide 18 is thicker than path guide 14 allowing the guide roller 39 of the operable carrier 19 to pass under path guide 14 but to engage path guide 18. FIG. 11 shows the relationship between the upper helical bearing 43 and the second projection 23*b* of overhead rail 21 as well as the relationship between the lower helical bearing 41 and the third projection 23*c*. FIG. 12 illustrates the relationship between the operable carriers 17, 19 and the first projections 23*a*, 29*a*, 31*a* of overhead rails 23, 29, 31 respectively. FIG. 12 also illustrates the relationship between the operable carriers 17, 19 and the second projections 23*b*, 29*b*, 31*b* of overhead rails 23, 29, 31 respectively. Both FIGS. 11 and 12 illustrate a top portion of the movable panel 11 in relationship to the overhead rails 23, 29, 31. The top portion of the movable panel 11 is shown with the infill panel 35 surrounded by the top rail 37*a*, and vertical stiles 37*b*, 37*c*. In FIG. 11 the threaded fasteners 47 of the operable carriers 17, 19 are shown secured in a groove 37*e* in the top rail 37*a* via the insert 50.

FIGS. 1-4 and 9-12 illustrate an arrangement of overhead rails 21, 23, 25, 27, 29, 31, and path guides 12, 14, 16, 18, in combination with movable panels 11 can each sliding along the overhead rails 21, 23, 25, 27, 29, 31. FIGS. 13-20 illustrate portions of a movable partition system 10. As illustrated in FIGS. 13, 14, 17, 19-21, the movable panels 57, 58, 59 slide are configured as a slidable folding panel assembly 56 with only one of the movable panels 58 engaging the overhead rails 52, 53, 54, 55 and path guide 12 via operable carriers 17, 19 and guide rollers 39. A complete system may include one or more slidable folding panel assembly 56, or one or more slidable folding panel assemblies 56 in combination with one or more fixed or sliding panels. For simplicity, one of a slidable folding panel assembly 56 is illustrated. The movable panels 57, 58, 59 slide as a unit by virtue of hinges and hinges 61 hinging the movable panel 57 and movable panel 59 in opposite directions about movable panel 58. Hinge 60 hinges the movable panel 59 about the movable panel 58. Hinge 61 hinges the movable panel 57 about movable panel 58. The combination of overhead rails 52, 53, 54, 55 illustrated is but one example of an alternative to the rail combination of FIG. 1. Many other arrangements and combinations of overhead rails can easily be used for the movable partition system 10 of this disclosure.

Figure 13:
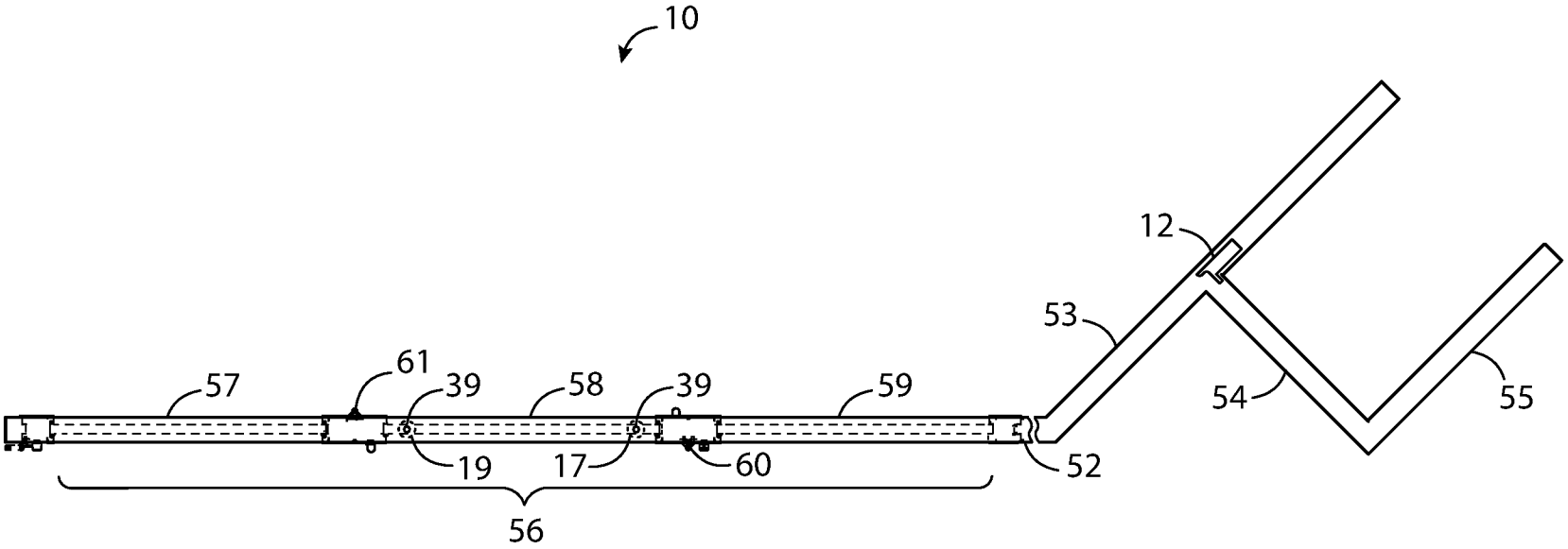
FIG. 13 illustrates, in top plan view, a movable partition system of the present disclosure with a combination of overhead rails and with a slidable folding panel assembly in the closed position.

FIGS. 13, 14, 17, and 19-21 show a typical sequence for opening the slidable folding panel assembly 56 from an extended or closed position to an open position or end position. Referring to FIG. 13, the slidable folding panel assembly 56 is in a closed or extended position with movable panels 57,58, 59 extended horizontally along overhead rail 52. The movable panels 57, 58, 59 are illustrated in dashed (i.e. broken) lines to indicate that they are hidden below the rail. The doors can be optionally locked by a lock 62 as shown in FIG. 15. The lock can any lock suitable for the particular application or desired level of security. For example, a mortise deadbolt lockset or a three-point lockset, among others, could be used for secure a storefront.

Figure 14:
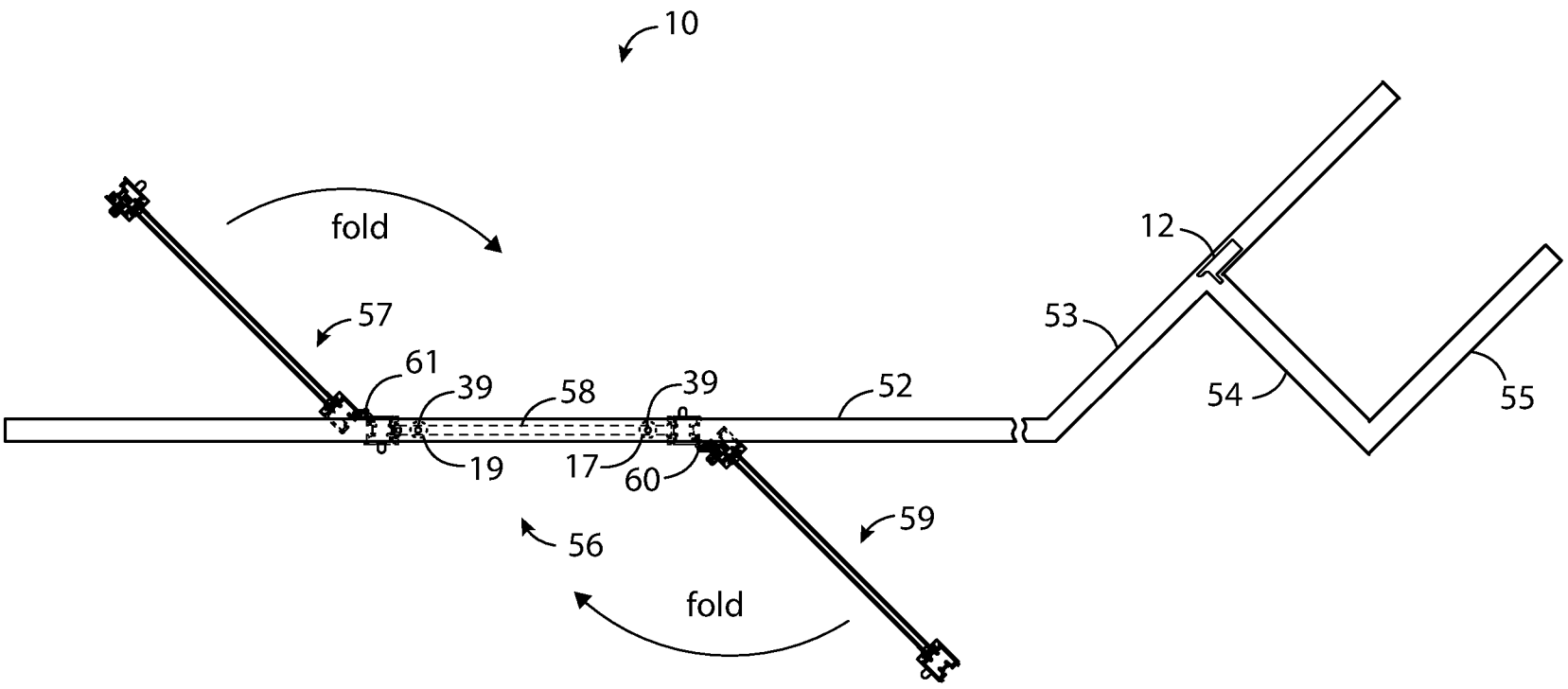
FIG. 14 illustrates, in top plan view, the movable partition system of FIG. 13 with one movable panel opening inwardly, and another movable panel opening outwardly.
Figure 15:
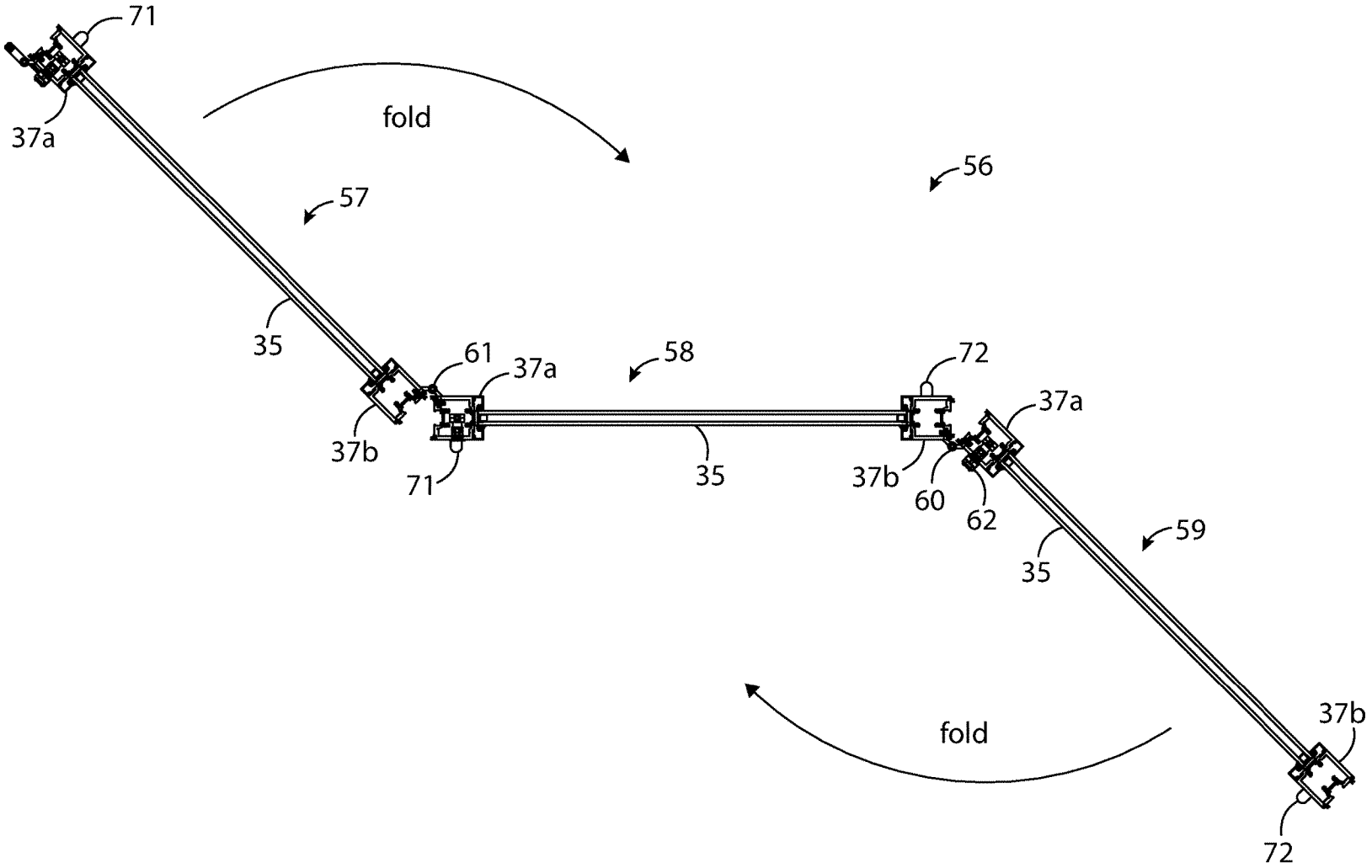
FIG. 15 illustrates, in top plan view, the slidable folding panel assembly of FIG. 14 in greater detail.
Figure 16:
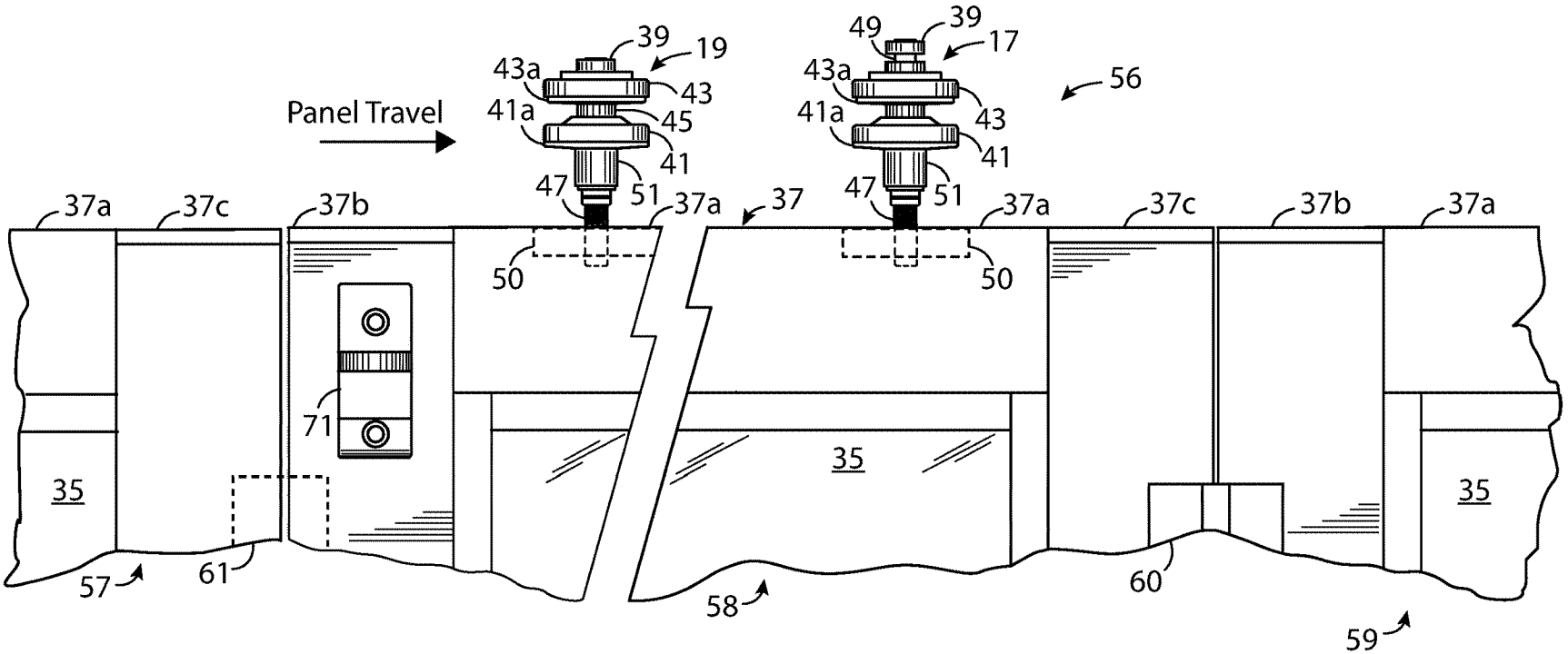
FIG. 16 illustrates an enlarged view of a top portion of the slidable folding panel assembly of FIG. 13 showing the movable carriers attached to the top rail of center movable panel.
Figure 17:
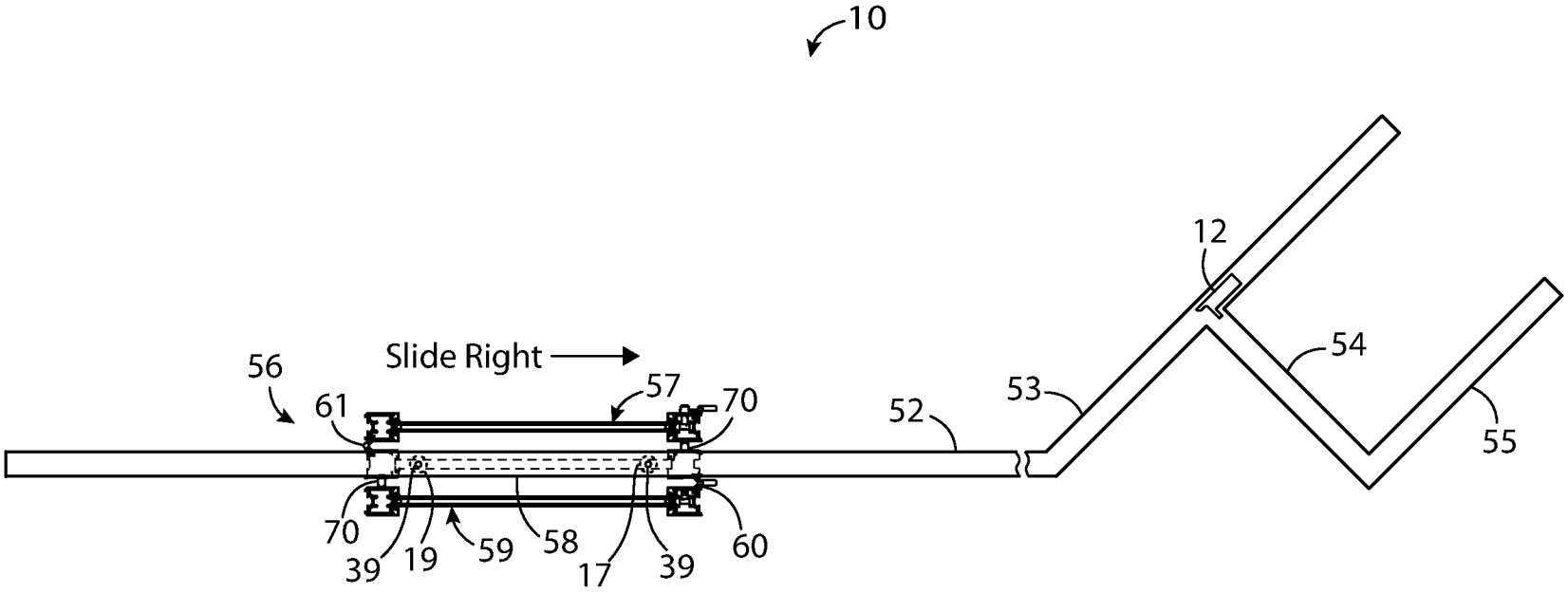
FIG. 17 illustrates, in top plan view, the movable panels of FIG. 13 folded and optionally latched.

Referring to FIGS. 14 and 15, movable panel 57 and movable panel 59, fold on opposite sides of the movable panel 58 because they are hinged on opposite sides of movable panel 58, i.e. hinge 60 and hinge 61 are on opposite sides of the movable panel 58. FIG. 15 illustrates additional detail such as an infill panel 35 and vertical stiles 37*b*, 37*c*. The top rail 37*a*, which is shown in FIG. 16, is removed in FIG. 15 for clarity. The infill panel 35 is illustrated as a glass or glazed infill such as an IGU. As previously discussed for FIGS. 1-12, the movable panels 11 can be any movable panel 11 that meet the architectural or building requirements, such as wood, metal, or glazed panels. Referring to FIGS. 14 and 17, folding the movable panels 57, 59 about opposite faces of movable panel 58, allows the panels to slide together as with only movable panel 58 engaged with overhead rails 52, 53, 54, 55 via operable carriers 17, 19. The operable carriers 17, 19 are shown in dashed or broken lines to indicate that they are hidden or partially hidden within the overhead rail 52.

Figure 18:
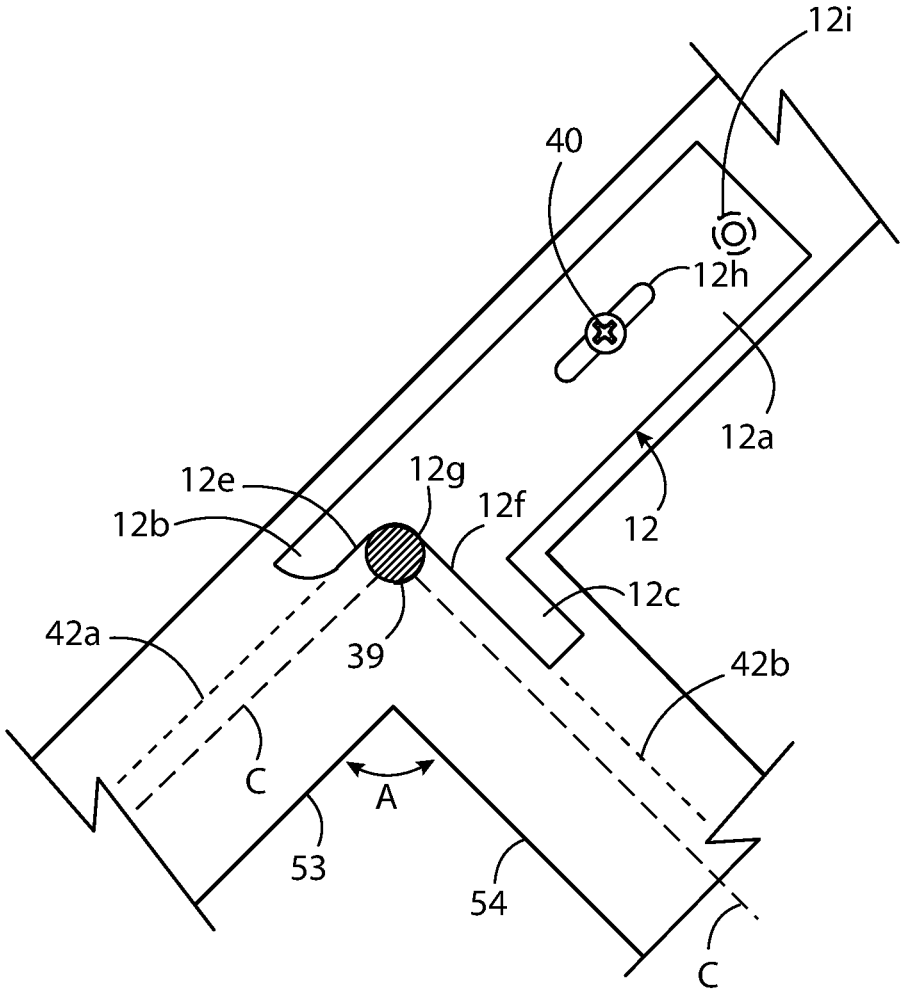
FIG. 18 illustrates an enlarged view of a portion of FIG. 16 showing the first path guide at the juncture of two overhead rails.
Figure 19:
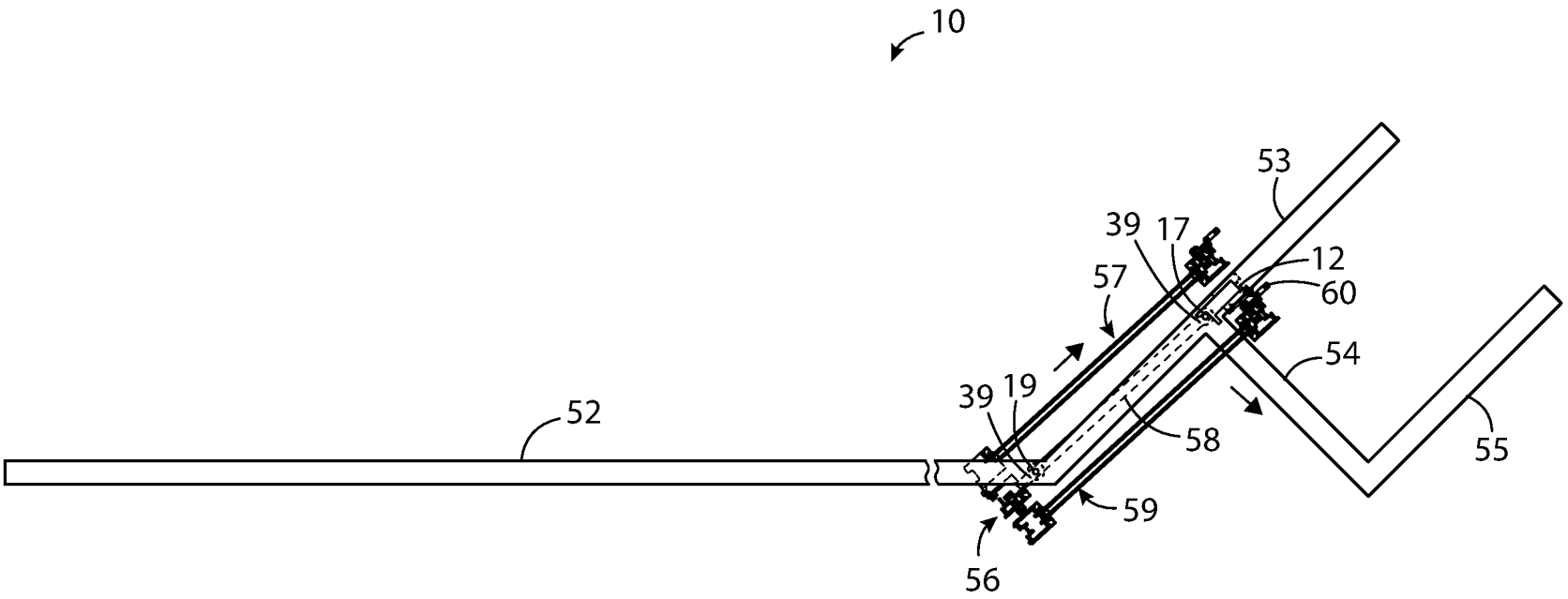
FIG. 19 illustrates, in top plan view, the movable partition system of FIG. 13 with the movable panels slid so that an operable carrier attached to the center panel engages the path guide.

Referring to FIG. 19, the right side, or leading side, of the slidable folding panel assembly 56 is slid to the juncture of overhead rail 53 and overhead rail 54 where the guide roller 39 of operable carrier 17 encounters the path guide 12 and is diverted along the path guide 12. Referring to FIG. 18, the path guide 12 shown with the first projection 12*b* projecting from the main body 12*a* length-wise along the overhead rail 53 and into the juncture between the overhead rail 53 and overhead rail 54. The first running surface 12*e* is formed along the inside edge of the first projection 12*b* and can run longitudinally along the overhead rail 53 parallel to the length-wise center line C of the overhead rail 53. The second projection 12*c* can projects from the main body 12*a* longitudinally (i.e. length-wise) into the overhead rail 54 from the juncture between the overhead rails 53 and overhead rail 54. The second running surface 12*f* is formed along the inside edge of the second projection 12*c* and can run length-wise along the overhead rail 54 parallel to the length-wise centerline C of the overhead rail 54. The first running surface 12*e* and the second running surface 12*f* are joined by the radiused junction 12*g*. The curve of the radiused junction 12*g* can be a circular section with a radius approximately equal to the outside circumference of the guide roller 39. This will help create a naturally smooth transition between the first running surface 12*e* and the second running surface 12*f* for the guide roller 39. The angle between the overhead rails 53, 54 is depicted by angle A. The angle between the first running surface 12*e* and the second running surface 12*f* is equal to angle A. In FIG. 6, angle A is shown as 90-degrees. However, it is possible that angle A can be greater than 90-degrees (i.e. obtuse) and the inventor envisions that the path guide 12, can be used where the angle A is 90-degrees or greater.

Continuing to refer to FIG. 18, the center of the guide roller 39 can be configured to move along the length-wise center lines C of the overhead rails 53, 54 respectively. The outside circumference of the guide roller 39, therefore moves along a path 42*a* within overhead rail 53 and a path 42*b* within overhead rail 54 that is parallel to the length-wise centerlines C of overhead rail 53 and overhead rail 54 respectively. In this configuration, the path guide 12 is sized and positioned so that the first running surface 12*e* is aligned along path 42*a* and the second running surface 12*f* is aligned along path 42*b*. This alignment assures that the first running surface 12*e* and the second running surface 12*f* tangent to the outside circumference of the guide roller 39.

As previously discussed for the movable partition system 10 of FIG. 1, the operable carriers 17, 19 of FIG. 16 are typically self-aligning, meaning that operable carriers 17, 19 will self-correct their position to stay substantially centered in their respective overhead rails 52, 53, 54, 55 of FIGS. 13, 14, 17, and 19-21. As a result, the guide roller 39 will self-center. Referring again to FIG. 18, this means that while the guide roller 39 may wobble slightly as the movable panels 11 are slid, they will self-correct so that the tangent of the outer circumference of the guide roller 39 to move substantially along paths 42*a*, 42*b*. As previously discussed, the inventor was able to take advantage of the self-centering tendency of the guide roller 39 by convexly radiusing the leading edge 12*d* of the first projection 12*b*. If the center of the guide roller 39 is moving on centerline C of overhead rail 53, the guide roller 39 will directly engage the first running surface 12*e* tangent to the outer circumference of the guide roller 39. In this scenario, the guide roller 39 has intersected the first running surface 12*e* will a minimal resistance. If the guide roller 39 has wobbled from center the outer circumference of the guide roller 39 will engage the leading edge 12*d* of the first projection 12*b*. Because the leading edge 12*d* is convexly radiused, it will push the guide roller 39 back to center causing the outer circumference to guide roller 39 the first running surface 12*e*.

In order to account for variances in the alignment of the overhead rails 53, 54 during assembly, the position of the second running surface 12*f* can be adjusted to align along path 42*b* by loosening the threaded fastener 40 and moving the path guide 12 along slot 12*h*. Optionally, after alignment, in order to further affix the path guide 12 to the overhead rail 21, a hole can be drilled into both the top of the overhead rail 21 and into the main body 12*a*, for example, at position 12*i*, with the two holes secured by a threaded fastener.

Figure 20:
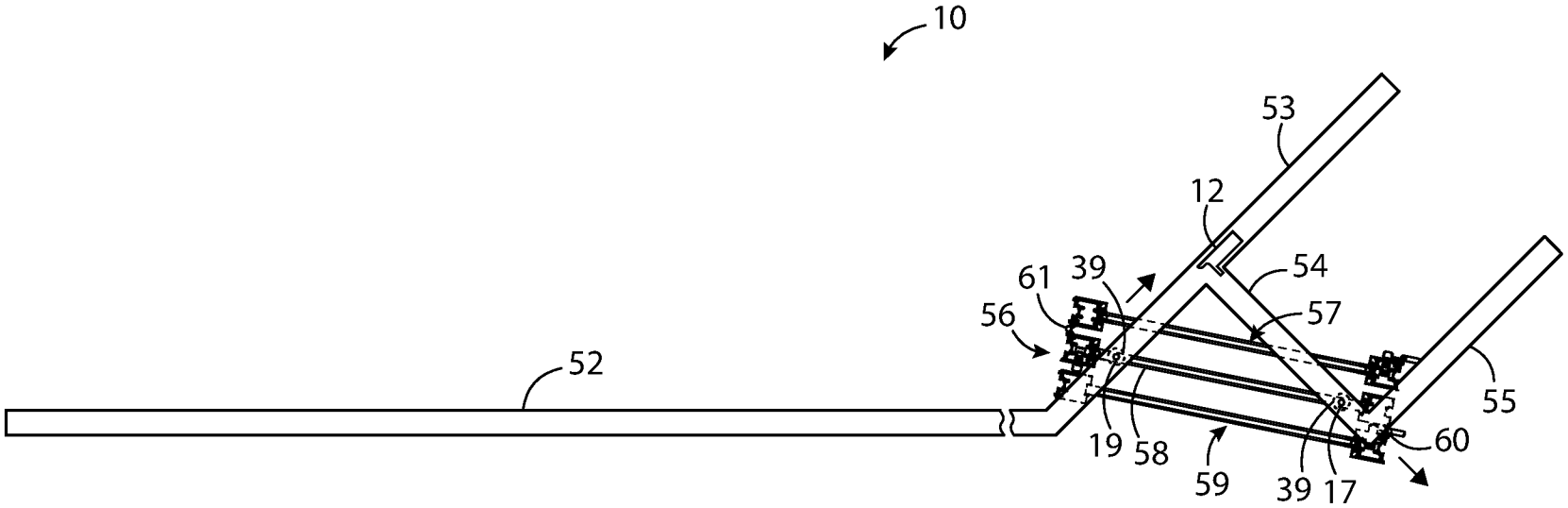
FIG. 20 illustrates, in top plan view, the movable partition system of FIG. 13 with the movable panels sliding along both two of the overhead rails.
Figure 21:
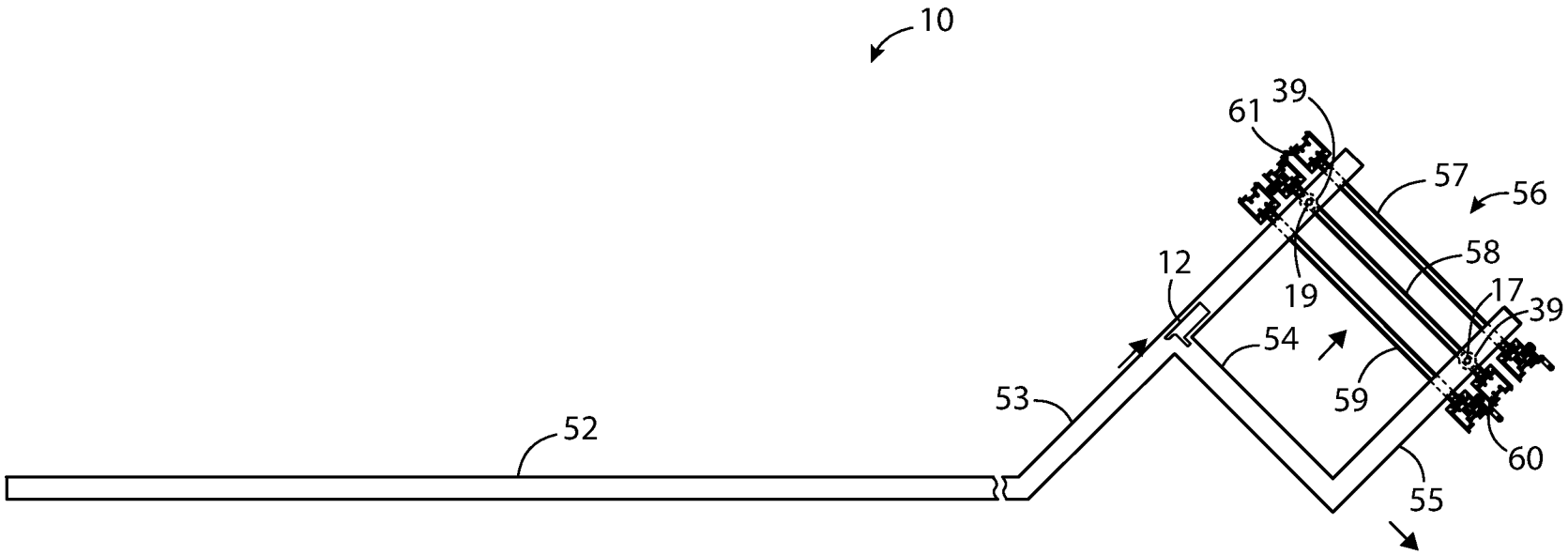
FIG. 21 illustrates, in top plan view, movable panels moved to their fully open position.

Referring to FIG. 20 the operable carrier 17 guides the right side of the slidable folding panel assembly 56 along overhead rail 54 toward overhead rail 55. Operable carrier 19 guides the left side of the slidable folding panel assembly 56 along overhead rail 53 toward path guide 12. In FIG. 21, operable carrier 17 has guided the right-hand side of the slidable folding panel assembly 56 to an open position along overhead rail 55. Operable carrier 19 guided the left-hand side of the slidable folding panel assembly 56 past path guide 12 to an open position along overhead rail 53. Referring to FIG. 16, the guide roller 39 of the operable carrier 17 extends upward a distance to engage the path guide 12 while the guide roller 39 of the operable carrier 19 extends upward a lesser distance so as not to engage (i.e. bypass) path guide 12.

In order to better understand how this works, FIG. 16 illustrates an enlarged view of a top portion of the slidable folding panel assembly 56 of FIG. 13 showing the operable carriers 17, 19 attached to the top rail 37*a* of the sash 37 of the movable panel 58. The movable panels 57, 59 do not need the operable carriers 17, 19 since only movable panel 58 slides along overhead rails 52, 53, 54, 55 of FIG. 13. As previously described, the movable panels 57, 59 are hinged to movable panel 58. FIG. 16 shows a portion of the hinge 60 mounted to an upper portion of the vertical stile 37*c* of movable panel 58 and an upper portion of the vertical stile 37*b* of movable panel 59. While only a portion of one of the hinge 60 is shown, the movable panels 58, 59 can be hinged together by two, three or more hinges 60. Similarly, a portion of the hinge 61 is mounted to an upper portion of the vertical stile 37*c* of movable panel 57 and an upper portion of the vertical stile 37*b* of movable panel 58. The hinge 61 is shown in dashed, or broken lines, to indicate it is hidden from view and mounted on the opposite face of the slidable folding panel assembly 56. Again, while only a portion of one of the hinge 61 is shown, the movable panels 57, 58 can be hinged together by two, three or more hinges 61.

As previously discussed for FIG. 5, operable carriers 17, 19 are virtually identical except for the height of the guide roller 39 relative to top rail 37*a* thanks to the height of spindle 49. The height of the guide roller 39 of operable carrier 17 is set to engage path guide 12, while the height of guide roller 39 of operable carrier 19 is set as to not engage path guide 12. The other components of the operable carriers 17, 19 including the upper helical bearing 43, upper bearing lower surface 43*a*, lower helical bearing 41, lower bearing lower surface 41*a*, spacer 45, bearing 51, and other components are in the same functional and structural relationship as described for FIG. 5. Similarly the operable carriers 17, 19 can be secured to the to the top rail 37*a* by a threaded fastener 47 extending from each operable carrier 17, 19 and into a corresponding insert 50 in the top rail 37*a* as previously described for FIG. 5. Alternatively, the operable carriers 17, 19 can be secured to the movable panel 58 by other threaded or non-threaded fasteners, inserts in combination with threaded fasteners, or other fastening combinations capable of support the weight of all three of the movable panels 57, 58, 59 in the overhead rails 52, 53, 54, 55 of FIG. 13. As previously discussed, the operable carriers 17, 19 are not limited to the operable carriers 17, 19 illustrated. Other self-centering overhead carriers that utilize a horizontal guide roller rotatable about a vertical axis can be utilized. For example, the carriers illustrated in U.S. Pat. No. 3,879,799 "Multidirectional Suspension System for Operable Partitions," (Williams) and U.S. Pat. No. 5,230,123, "Operable Wall Deployment and Storage System" (Williams). In addition, systems with self-aligning horizontal roller that engage inside projected surfaces of the overhead rails can be used.

Figure 22:
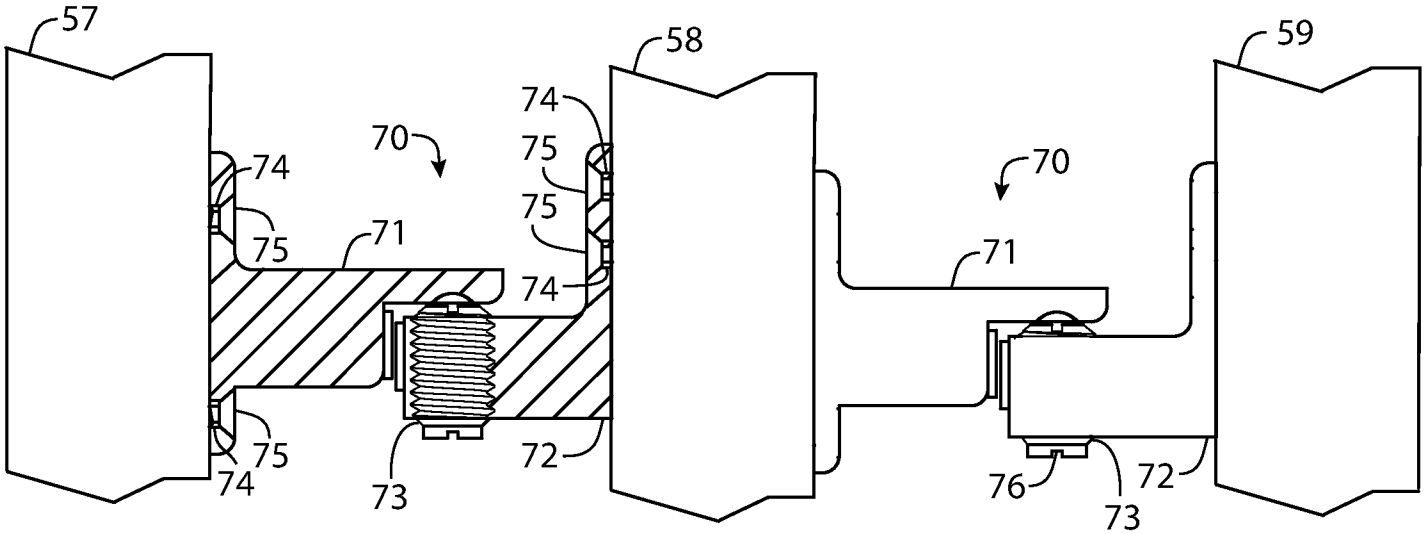
FIG. 22 illustrates, in side view along view lines 22-22, an upper portion the slidable folding panel assembly of FIG. 17 showing the option showing optional door catches.

In order to help facilitate movement of the slidable folding panel assembly 56, the door panels can optionally be latched together using a door catch 70 as shown in FIG. 17 and in more detail in FIG. 22. The door catch 70 illustrated in FIG. 22 is from the inventor's U.S. Pat. No. 9,228,387 "Door Catch," issued Jan. 5, 2016. This door catch 70 is shown as an example. Any suitable door catches or door-to-door latching mechanisms could be used that have sufficient strength to hold the doors together while they are being slid or slid and pivoted along overhead rails, such as the overhead rails 52, 53, 54, 55 of FIG. 13. FIG. 22 shows a side view of movable panels 57, 58, 59 shown in side view along view lines 22-22 of FIG. 17. For clarity, the door catch 70 between movable panel 57 and movable panel 58 is illustrated in section view. Referring to FIG. 22, the door catch 70 includes a catch bar bracket 71 and a catch bar base 72. The catch bar bracket 71 is also shown in FIGS. 15 and 17. The catch bar base 72 is also shown in FIG. 15. Referring back to FIG. 22, the catch bar bracket 71 and the catch bar base 72 are held in tension by ball catch 73 and a detent at the bottom of the catch bar bracket 71. The tension of the ball catch 73 is adjustable by threadably moving the ball catch 73 up or down within the catch bar base 72. A tool-receiving end 76 receives a wrench, screw driver, hex-key or other tool to facilitate turning of the ball catch 73. The door catches 70 are fastened to the movable panels 57, 58, 59 by threaded fasteners 74 through apertures 75.

Figure 23:
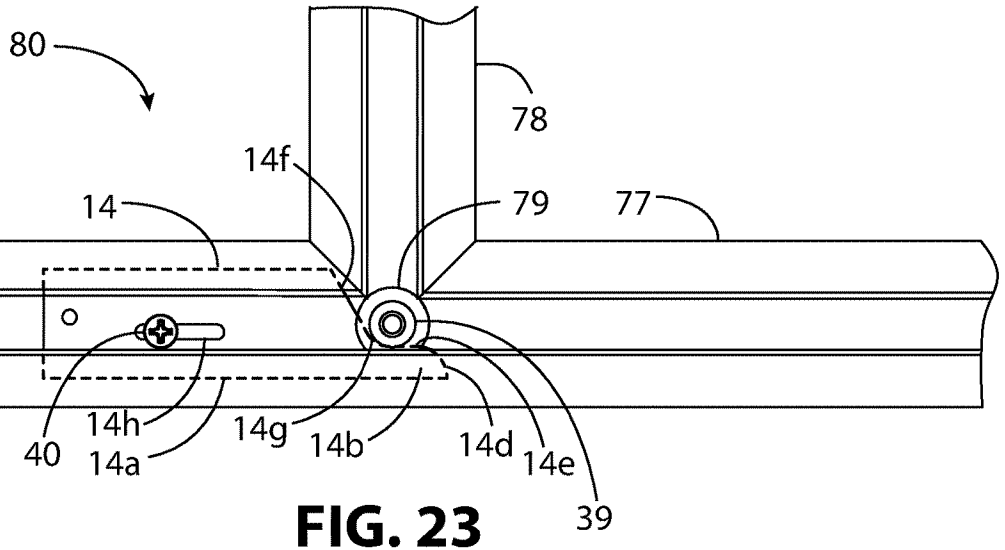
FIG. 23 illustrates, in top plan view, an optional bottom rail system using a path guide of the present disclosure with the movable panel removed for clarity.
Figure 24:
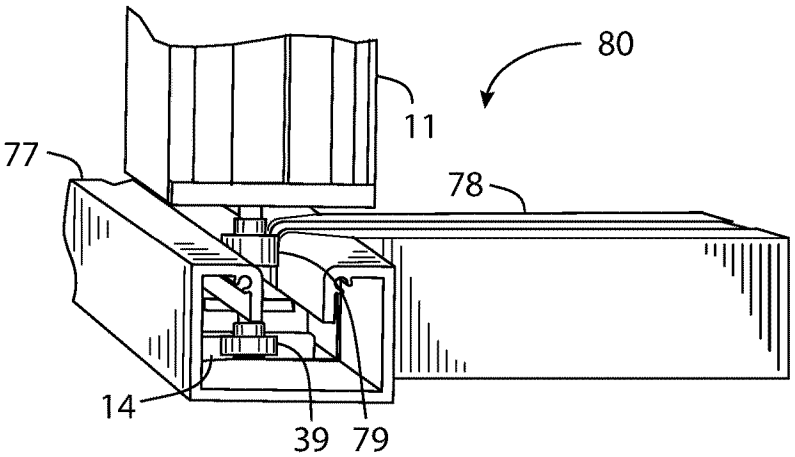
FIG. 24 illustrates, in perspective view, an optional bottom rail system using the path guide of the FIG. 23.

As previously discussed, one of the advantages of the movable partition system 10 of the present disclosure is that a bottom rail system is optional. In some conditions, for example, when the movable partitions are heavy glazed door panels or heavy sliding folding panel assemblies, it may be desirable to add a bottom rail. FIG. 23 illustrates, in top plan view, an optional bottom rail system 80 using a path guide of the present disclosure, such as the path guide 14. The movable panel 11, shown in FIG. 24, is removed for clarity. FIG. 24 illustrates, in perspective view, the optional bottom rail system 80 using a path guide 14 of the FIG. 23. Referring to FIGS. 23 and 24, the path guide 14 is shown as described for FIG. 7 including the main body 14*a*, the first projection 14*b*, the leading edge 14*d*, the first running surface 14*e*, and the second running surface 14*f*, and radiused junction 14*g*. The guide roller 39 interacts and aligns with the path guide 14 in the same way as previously described. As described for FIG. 7, the guide roller 39 moves optionally along the leading edge 14*d* and then along the first running surface 14*e* and the second running surface 14*f*. The first running surface 14*e* and the second running surface 14*f* are positioned along the tangent of the outer circumference of the guide roller 39. The guide roller 39 is centered along the length-wise axis of the bottom rails 77, 78. The path guide 14 is aligned at the junction between a bottom rail 77 and a bottom rail 78. The position of the path guide 14 is adjustable via a threaded fastener 40 and the slot 14*h* as described for FIG. 7. The door panel (FIG. 24) is moves along the bottom rails 77, 78 via a horizontal roller 79. While a horizontal roller 79 is illustrated, the optional bottom rail system 80 is not limited to a horizontal roller 79, a helical bearing, such as those previously described could easily be substituted. In addition, while path guide 14 is shown, path guide 12 could readily be substituted and still within the scope of the optional bottom rail system 80.

A movable partition system 10 that includes path guides 12, 14, 16, 18 has been described. It is not the intent of this disclosure to limit the claimed invention to the examples, variations, and exemplary embodiments described in the specification. Those skilled in the art will recognize that variations will occur when embodying the claimed invention in specific implementations and environments. For example, while a specific combination of overhead rails 21, 23, 25, 27, 29, 31 has been illustrated, such as the combination of FIGS. 1-4 and FIGS. 9-12, and an alternative combination illustrated in FIGS. 13-20, other rail combinations are possible. In another example, additional overhead rails could be added in parallel or series in various combinations of right-angle and obtuse junction between rails, or all right-angle junctions between rails, or all obtuse junctions between rails, that would still be within the spirit of the movable partition system 10 disclosed. In a further example, as previously discussed, the path guide 12 of FIGS. 6, 9, and 10, and its thicker counterpart the path guide 16 of FIGS. 9 and 10, while illustrated with a 90-degree angle between the first running surface 12*e*, 16*e* and the second running surface 12*f*, 16*f*, could be adapted for use with obtuse angles and still be within the spirit of the movable partition system 10. Path guides are shown in various combinations throughout this disclosure. The claimed invention is not limited to these particular combination of path guides. The inventor envisions that the path guides can be implemented in a variety of combinations. For example, while path guide 12 of FIGS. 6, 9, and 10 is shown with its thicker counterpart, the path guide 16 of FIGS. 9 and 10, path guide 12 or path guide 16 can be implemented individually without the other. Similarly, in FIG. 1, path guide 14 and 18 are illustrated in combination, these also can be implemented individually without the other.

While the slidable folding panel assembly 56 of FIGS. 13-17 and 19-21 is illustrated with the path guide 12, and overhead rails 52, 53, 54, 55, the inventor envisions that the slidable folding panel assembly 56 can be implemented in a variety of environments, with a variety of overhead rail combinations, with or without path guides or with path guides other than the path guides 12, 14, 16, 18 illustrated in this disclosure.

It is possible to implement certain features described in separate embodiments in combination within a single embodiment. Similarly, it is possible to implement certain features described in single embodiments either separately or in combination in multiple embodiments. The inventor envisions that these variations fall within the scope of the claimed invention. For example, the slidable folding panel assembly 56 of FIGS. 13-17 and 19-21 can be implemented in a track assembly similar to FIGS. 1-3 with by reversing the operable carriers 17, 19 shown in FIG. 18 so they are configured similarly to FIG. 5. Similarly, the movable panels 11 can be implemented in the overhead rail combination of FIGS. 13, 14, 17, and 19-21 by reversing the order of the operable carriers 17, 19 in FIG. 5 as illustrated in FIG. 18. As another example, the optional bottom rail system 80 of FIGS. 23 and 24 could be implemented in any of the other examples given throughout this disclosure.

While the examples, exemplary embodiments, and variations are helpful to those skilled in the art in understanding the claimed invention, it should be understood that, the scope of the claimed invention is defined solely by the following claims and their equivalents.

What is claimed is:

1. A movable partition system for directing a horizontal roller and a movable partition, comprising:

a first overhead rail, a second overhead rail extending from the first overhead rail, a rail junction defining an interior space at a junction between the first overhead rail and the second overhead rail;

a path guide including a main body, the main body including a first portion positioned outside the rail junction between first opposing length-wise peripheral edges of the first overhead rail and a second portion positioned within the rail junction; and the main body is captively slidable and securable between the first opposing length-wise peripheral edges thereby adjustably positioning the path guide within the rail junction.

2. The movable partition system of claim 1, wherein:

the main body includes a slot; and the main body is captively slidable and securable utilizing the slot.

3. The movable partition system of claim 1, further including:

the path guide is a first path guide; and a second path guide sized and shaped substantially the same as the first path guide except including a different thickness.

4. A movable partition system for directing a horizontal roller and a movable partition, comprising:

a first overhead rail, a second overhead rail extending from the first overhead rail, a rail junction defining an interior space at a junction between the first overhead rail and the second overhead rail;

a path guide including a main body with a portion positioned outside the rail junction between first opposing length-wise peripheral edges of the first overhead rail;

the main body is captively slidable and securable between the first opposing length-wise peripheral edges thereby adjustably positioning the path guide within the rail junction; and the path guide includes a projection projecting away from the main body to between second opposing length-wise peripheral edges of the second overhead rail lying outside the rail junction.

5. A movable partition system for directing a horizontal roller and a movable partition, comprising:

a first overhead rail, a second overhead rail extending from the first overhead rail, a rail junction defining an interior space at a junction between the first overhead rail and the second overhead rail;

a path guide including a main body with a first portion positioned outside the rail junction between first opposing length-wise peripheral edges of the first overhead rail, a first running surface and a second running surface together positioned with respect to the main body to direct the horizontal roller from the first overhead rail to the second overhead rail; and the main body is captively slidable and securable between the first opposing length-wise peripheral edges thereby adjustably positioning the first running surface and the second running surface within the rail junction.

6. The movable partition system of claim 5, wherein:

the second running surface is disposed along the main body.

7. The movable partition system of claim 5, wherein:

the path guide includes a radiused junction positioned between the first running surface and the second running surface.

8. The movable partition system of claim 7, wherein:

the second running surface is disposed along the main body.

9. The movable partition system of claim 5, wherein:

the path guide includes a second projection projecting away from the main body to between second opposing length-wise peripheral edges of the second overhead rail lying outside the rail junction, and the second running surface disposed along a second inward facing edge of the second projection.

10. The movable partition system of claim 5, wherein:

the main body includes a slot; and the main body is captively slidable and securable utilizing the slot.

11. The movable partition system of claim 5, further including:

the path guide is a first path guide; and a second path guide sized and shaped substantially the same as the first path guide except including a different thickness.

12. A movable partition system, comprising:

a first overhead rail, a second overhead rail extending from the first overhead rail, a rail junction defining an interior space at a junction between the first overhead rail and the second overhead rail;

a path guide including a main body with a first portion positioned outside the rail junction between first opposing length-wise peripheral edges of the first overhead rail, a first projection projecting away from the main body into the rail junction, a first running surface disposed along an inward facing edge of the first projection and parallel to the first opposing length-wise peripheral edges, a second running surface positioned parallel to second opposing length-wise peripheral edges of the second overhead rail; and the main body is captively slidable and securable between the first opposing length-wise peripheral edges thereby adjustably positioning the first running surface and the second running surface within the rail junction.

13. The movable partition system of claim 12, wherein:

the second running surface is disposed along the main body.

14. The movable partition system of claim 12, wherein:

the path guide includes a radiused junction positioned between the first running surface and the second running surface.

15. The movable partition system of claim 14, wherein:

the second running surface is disposed along the main body.

16. The movable partition system of claim 12, wherein:

the path guide includes a second projection projecting away from the main body to between second opposing length-wise peripheral edges of the second overhead rail lying outside the rail junction, and the second running surface disposed along a second inward facing edge of the second projection.

17. The movable partition system of claim 12, wherein:

the main body includes a slot; and the main body is captively slidable and securable utilizing the slot.

18. The movable partition system of claim 12, further including:

the path guide is a first path guide; and a second path guide sized and shaped substantially the same as the first path guide except including a different thickness.

* * * * *